US009022520B2

(12) United States Patent
Brady et al.

(10) Patent No.: US 9,022,520 B2
(45) Date of Patent: May 5, 2015

(54) PRINTHEAD STIFFENING

(71) Applicant: FUJIFILM Dimatix, Inc., Lebanon, NH (US)

(72) Inventors: David A. Brady, Plainfield, NH (US); Robert L. Wells, Jr., Thetford Center, VT (US); John Kelly, Lebanon, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 94 days.

(21) Appl. No.: 13/786,154

(22) Filed: Mar. 5, 2013

(65) Prior Publication Data

US 2013/0228084 A1 Sep. 5, 2013

Related U.S. Application Data

(60) Provisional application No. 61/606,709, filed on Mar. 5, 2012, provisional application No. 61/606,880, filed on Mar. 5, 2012.

(51) Int. Cl.

| | |
|---|---|
| ***B41J 2/015*** | (2006.01) |
| ***B41J 2/18*** | (2006.01) |
| ***B41J 27/10*** | (2006.01) |
| ***B41J 2/14*** | (2006.01) |

(52) U.S. Cl.

CPC .. *B41J 2/18* (2013.01); *B41J 27/10* (2013.01); *B41J 2/14274* (2013.01); *B41J 2002/14362* (2013.01); *B41J 2002/14491* (2013.01)

(58) Field of Classification Search

CPC .. B41J 2/1623; B41J 2/17596; B41J 2202/19; B41J 2/17523; B41J 2/175; B41J 2002/14419

USPC ..... 347/20, 40, 47, 54, 84, 85

See application file for complete search history.

(56) References Cited

U.S. PATENT DOCUMENTS

| | | | |
|---|---|---|---|
| 4,404,566 | A | 9/1983 | Clark et al. |
| 4,680,696 | A | 7/1987 | Ebinuma et al. |
| 4,891,654 | A | 1/1990 | Hoisington et al. |
| 5,701,149 | A | 12/1997 | Pagnon et al. |
| 5,818,485 | A | 10/1998 | Rezanka |
| 6,244,694 | B1 | 6/2001 | Weber et al. |
| 6,371,607 | B2 | 4/2002 | Wouters et al. |
| 6,517,197 | B2 | 2/2003 | Hawkins et al. |
| 8,091,988 | B2 | 1/2012 | McDonald |
| 8,491,100 | B2 * | 7/2013 | Moynihan et al. ..... 347/68 |

(Continued)

FOREIGN PATENT DOCUMENTS

| | | |
|---|---|---|
| JP | 2009-323431 | 12/1997 |
| JP | 2001-205810 | 7/2001 |
| WO | WO 2011/146069 | 11/2011 |

OTHER PUBLICATIONS

International Search Report & Written Opinion, PCT/US2013/029213, mailed Jun. 24, 2013, 10 pages.

(Continued)

*Primary Examiner* — An Do

(74) *Attorney, Agent, or Firm* — Fish & Richardson P.C.

(57) ABSTRACT

In general, in an aspect, an apparatus includes a body having a hollow ink refill chamber, a plate on a side of the body, the plate having a series of posts separating a series of hollow channels adjacent to the hollow ink refill chamber in the body.

30 Claims, 19 Drawing Sheets

(56) References Cited

U.S. PATENT DOCUMENTS

| | | | |
|---|---|---|---|
| 8,752,946 | B2 | 6/2014 | Wells, Jr. et al. |
| 2008/0049063 | A1 | 2/2008 | Nakamura et al. |
| 2009/0079801 | A1 | 3/2009 | Moynihan et al. |
| 2009/0290000 | A1 | 11/2009 | McDonald |
| 2011/0148988 | A1 | 6/2011 | Hoisington et al. |
| 2012/0050427 | A1 | 3/2012 | Rike et al. |

OTHER PUBLICATIONS

International Search Report & Written Opinion, PCT/US2013/029202, mailed Jun. 26, 2013, 17 pages.

* cited by examiner

PRINTHEAD STIFFENING

This patent application claims the benefit of the priority date of U.S. Provisional Patent Application No. 61/606,709, filed on Mar. 5, 2012, and U.S. Provisional Patent Application No. 61/606,880 filed on Mar. 5, 2012, pursuant to 35 U.S.C. 119. These provisional applications are herein incorporated by reference in their entirety. This application also incorporates U.S. application Ser. No. 13/786,360, filed on the same day as this patent application, in its entirety.

BACKGROUND

This description relates to printhead stiffening.

SUMMARY

In general, in an aspect, an apparatus includes a body having a hollow ink refill chamber, a structure on a side of the body, the structure having a series of posts separating a series of hollow channels adjacent to the hollow ink refill chamber in the body. The series of posts support the body against compressive forces applied across the hollow ink refill chamber.

Implementations may include one or more of the following features. The plate is attached to the body to stiffen the body. The plate is attached to the body by mechanical bonding. The apparatus further includes a compliant element on an opposite side of the plate from the body and not in contact with the series of posts. The body includes carbon, the plate includes stainless steel and the compliant membrane includes polyimide. The apparatus further includes a cavity plate between the plate and the compliant element. The cavity plate includes a series of pumping chambers separated by lands. The plate is adjacent to the body. A width of each post of the series of posts in the plate is within ±10% of a width of a corresponding one of the lands in the cavity plate. A thickness of each post of the series of posts corresponds to a thickness of the plate. The apparatus further includes a second plate adjacent to the body, the second plate having a second series of posts separating a second series of hollow channels adjacent to the hollow ink refill chamber in the body. The apparatus further includes a second compliant element on an opposite side of the second plate from the body and not in contact with the second series of posts. The apparatus further includes a second cavity plate having a second series of pumping chambers each separated by lands, the second cavity plate being between the second plate and the second compliant element.

In general, in an aspect, an apparatus includes an assembly having a body that includes a hollow ink refill chamber and a plate on a side of the body. The plate has a series of posts separating a series of hollow channels adjacent to the hollow ink refill chamber in the body. The apparatus includes a compliant element on an opposite side of the plate from the body and not in contact with the series of posts.

Implementations may include one or more of the following features. The plate is attached to the body by mechanical bonding. The body includes carbon, the plate includes stainless steel and the compliant membrane includes polyimide. The assembly is a jetting assembly, the jetting assembly further includes a cavity plate between the plate and the compliant element. The cavity plate includes a series of pumping chambers separated by lands, and piezoelectric elements in contact with the compliant membrane. The apparatus further includes a collar, a descender plate, and a nozzle plate. The jetting assembly is held within the collar and is fluidically connected to the descender plate and the nozzle plate. The apparatus further includes a housing and flexible circuits connect the jetting assembly to an exterior of the housing. The jetting assembly is enclosed by the housing.

In general, in an aspect, mechanical support is provided to a body having a hollow ink refill chamber in a direction orthogonal to a length of the hollow ink refill chamber; and a force is applied in the direction to secure the body to an assembly positioned along the direction and under the body.

Implementations may include one or more of the following features. The assembly positioned along the direction and under the body is detached from the body and is thereafter attached an assembly under the body. The mechanical support is provided through a series of posts separating a series of hollow channels adjacent to the hollow ink refill chamber in the body. The body includes carbon and the series of posts includes stainless steel. The body and the assembly are held together under pressure. The body and the assembly are not glued together. Aligned ink flow paths are formed between orifices in the body and descender tubes in the assembly when the force is applied in the direction to secure the body to the assembly.

In general, in an aspect, a body having a hollow ink refill chamber is provided, the body is contacted with a plate on a side of the body, the plate having a series of posts separating a series of hollow channels adjacent to the hollow ink refill chamber in the body.

Implementations may include one or more of the following features. A compliant element is provided on an opposite side of the plate from the body, and during use of the compliant element, the compliant element does not contact the series of posts. The body is contacted with a second plate on a second side of the body, the second plate having a second series of posts separating a second series of hollow channels adjacent to the hollow ink refill chamber in the body. A force is applied in a direction along a height of the series of the posts; and the body is attached to an assembly positioned along the direction and under the body. The body is detached from the assembly. The assembly, which includes a nozzle plate, is cleaned.

These and other features and aspects, and combinations of them, can be expressed as systems, components, apparatus, methods, means or steps for performing functions, methods of doing business, and in other ways.

Other features, aspects, implementations, and advantages will be apparent from the description and the claims.

DESCRIPTION

Figure 1A:
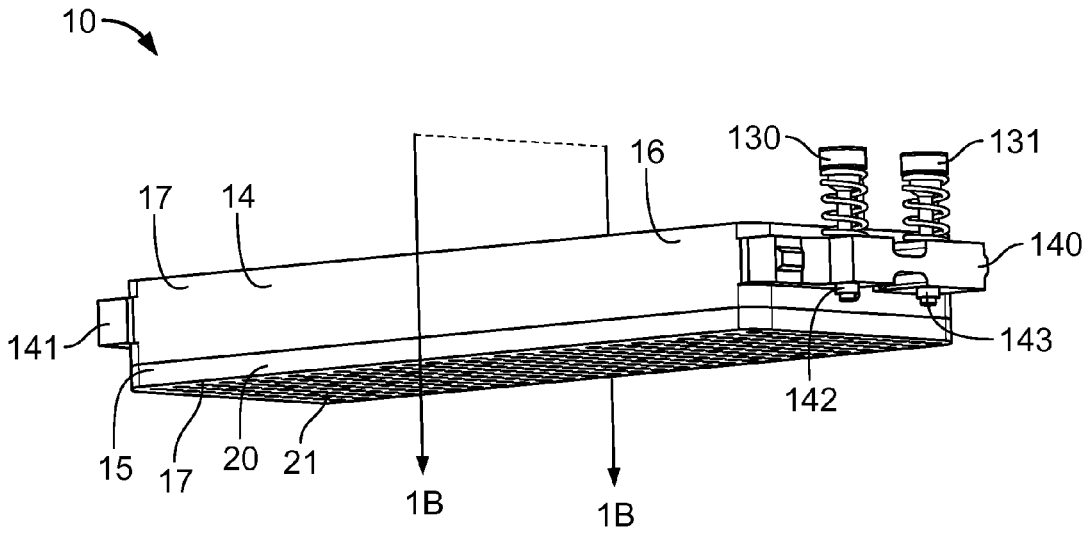
FIGS. 1A-1C are perspective, end, and magnified views of a nozzle plate assembly.

As shown in FIGS. 1A, 1B, 1C, 1D, and 1F, a nozzle plate assembly (or collar assembly) 10 includes a collar 14, an integrated recirculation manifold 15 separate from the collar 14, a stainless steel descender plate 17, a stainless steel nozzle recirculation plate 20, and an electroformed nickel nozzle plate 21. The collar, the recirculation manifold, the descender plate, the recirculation plate, and the nozzle plate all have the same peripheral size and shape.

A bottom surface 1012 of the collar 14 is joined using adhesives 1014 to an upper surface 1510 of the integrated recirculation manifold 15. The integrated recirculation manifold 15 is affixed using adhesives, such as epoxies, to a laminated piece 23 that includes the descender plate 17 and the nozzle recirculation plate 20. The lamination is done by gluing the descender plate 17 and the nozzle recirculation plate 20 together. The integrated recirculation manifold 15 integrates the flow paths of two recirculation systems. Details of the recirculation systems are described in [0297001], which is incorporated by reference in its entirety. A bottom surface 1018 of the recirculation plate 20 is then joined adhesively to the nozzle plate 21.

The collar and the integrated recirculation manifold 15 may be made of carbon, while the nozzle plate 21 may be an electroformed plate made of nickel. A membrane 1641 (also termed a "rock trap") has small holes 1643 at locations where the membrane 1641 covers corresponding descenders 194 in the manifold 15 (shown in FIG. 1C). Diameters of the small holes in the membrane 1641 are smaller than the diameters of the nozzles in order to prevent debris and other impurities from clogging the nozzles of the nozzle plate assembly 10.

Figure 1B:
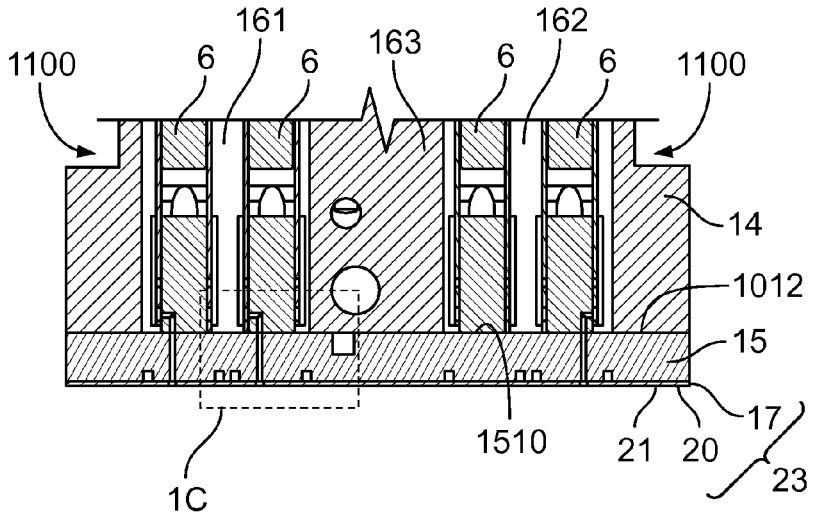

At opposite ends 16 and 17, the collar 14 includes corresponding protrusions 140 and 141. Protrusion 140 has two through-holes 142 and 143 through which two screws 130 and 131 can extend, while protrusion 141 has a single through-hole 144 (not shown) through which a screw 133 (not shown) can extend. The screws 130, 131, 132, and 133 allow the nozzle plate assembly 10 to be mounted with other printhead components, on a print bar 1016 (shown in FIG. 1E), or other supports As shown in FIG. 1B, the collar 14 includes slots 161 and 162 which are separated by a wall 163 that extends along the length of the collar 14. Two inkjet array modules 6 (one of which is shown, in an exploded perspective view, in FIG. 2A) can be mounted in each of the long rectangular slots 161 and 162 in the collar 14 such that a bottom edge 1640 of a carbon body 160 of the inkjet array module 6 contacts the upper surface 1510 of the integrated recirculation manifold 15 (see FIG. 1C).

Figure 1C:
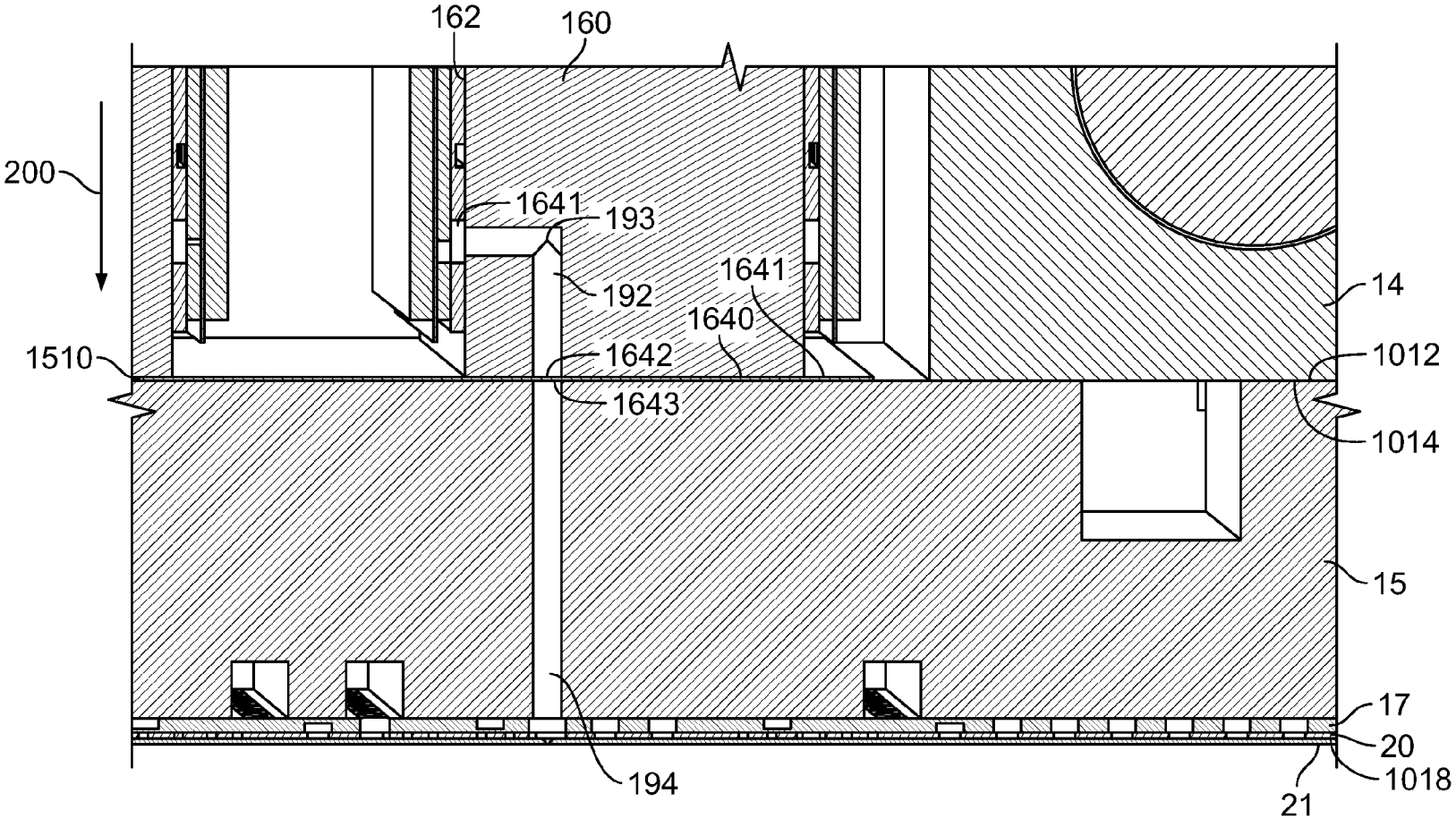

FIG. 1C, which shows a partial cross-section view of a carbon body 160 of an inkjet module 6 mounted within the slot 161 of the collar 14, is a magnified view of the area marked by a dotted rectangle in FIG. 1B. A descender 192 is defined in the carbon body 160 for each nozzle opening 250 of the inkjet array module. Each descender 192 includes a 90 degree bend 193 joining an orifice 1644 defined on the lower portion of a face 162 of the carbon body 160 to an orifice 1642 defined on the bottom edge 1640 of the carbon body 160. FIG. 1F shows a magnified view of FIG. 1C. The integrated recirculation manifold 15 has a recirculation return manifold 19 defined on its lower surface. Details of the recirculation return manifolds 19 are provided in [0297001], which is incorporated by reference in its entirety.

Figure 3A:
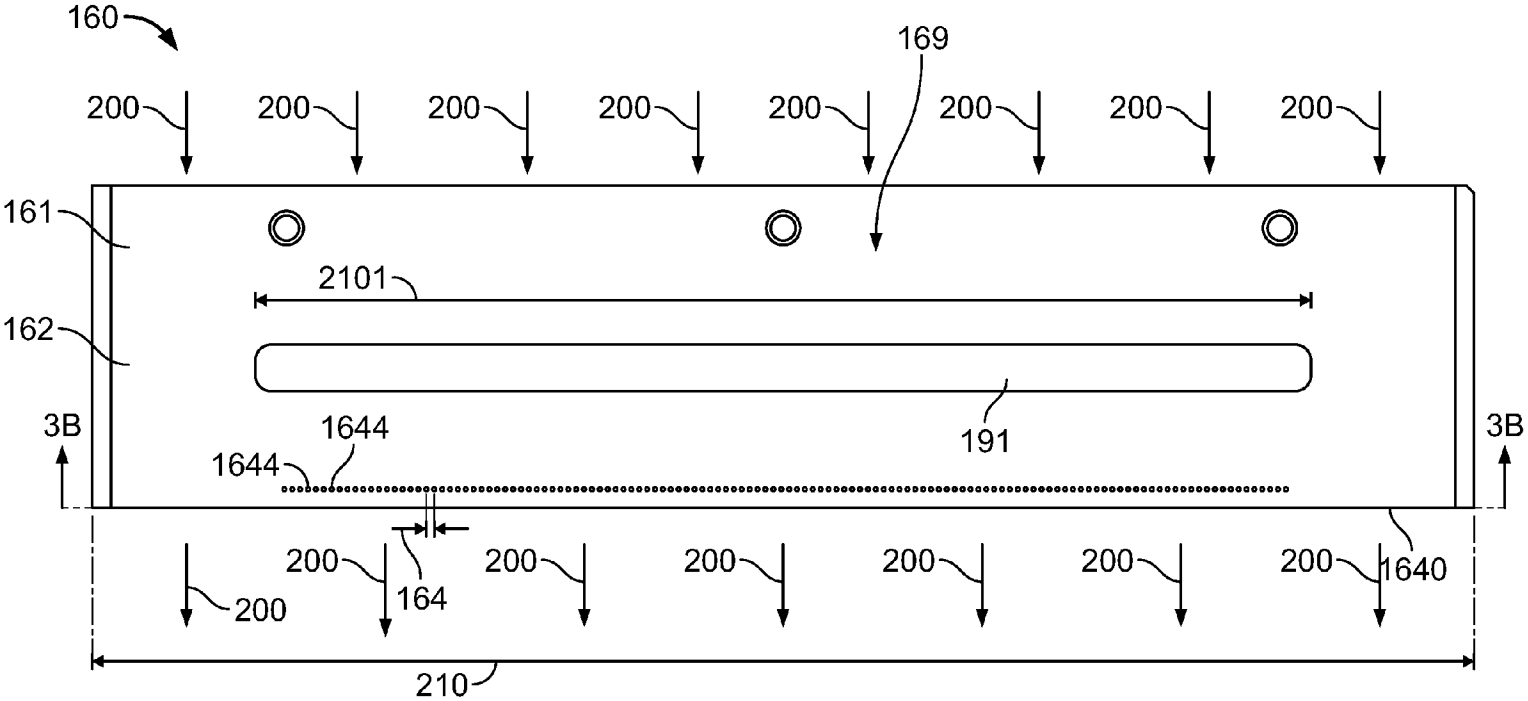
FIGS. 3A-3B are top and front views of a carbon body.
Figure 3B:
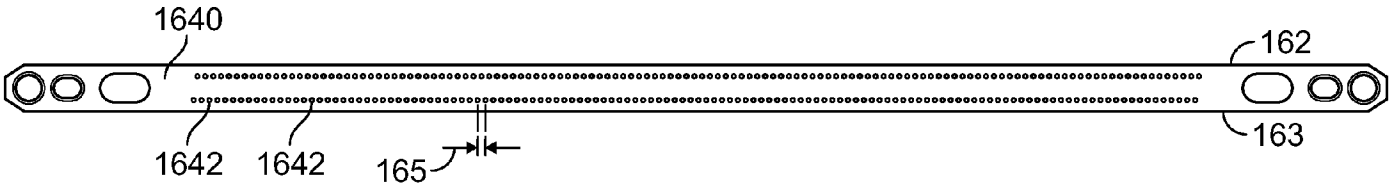

Detailed views of the carbon body 160 are provided in FIGS. 3A and 3B. There are two rows each having 128 orifices 1642 on the bottom surface 1640 of the carbon body because the face 162 and a face 163 opposite (into the plane of the drawing in FIG. 3A) the face 162 each has one row of the orifices 1644. A spacing 164 between the orifices 1644 is the same as a spacing 165 between the orifices 1642. The two rows of orifices are offset from one another along the length of the carbon body by a distance that is one half of the spacing between the orifices. In addition, the spacings 164 and 165 are also the same as the spacing between nozzle openings 250 (shown in FIG. 7G) in the nozzle plate 21. The descender 192 is shown in FIG. 1C to align with the descender 194 defined in the integrated recirculation manifold 15. Thus, an ink flow path is defined from the orifice 1641 through the 90° bend 193 through the hole in the rock trap and down the descender 194 to a descender 228 in the descender plate 17.

Figure 2A:
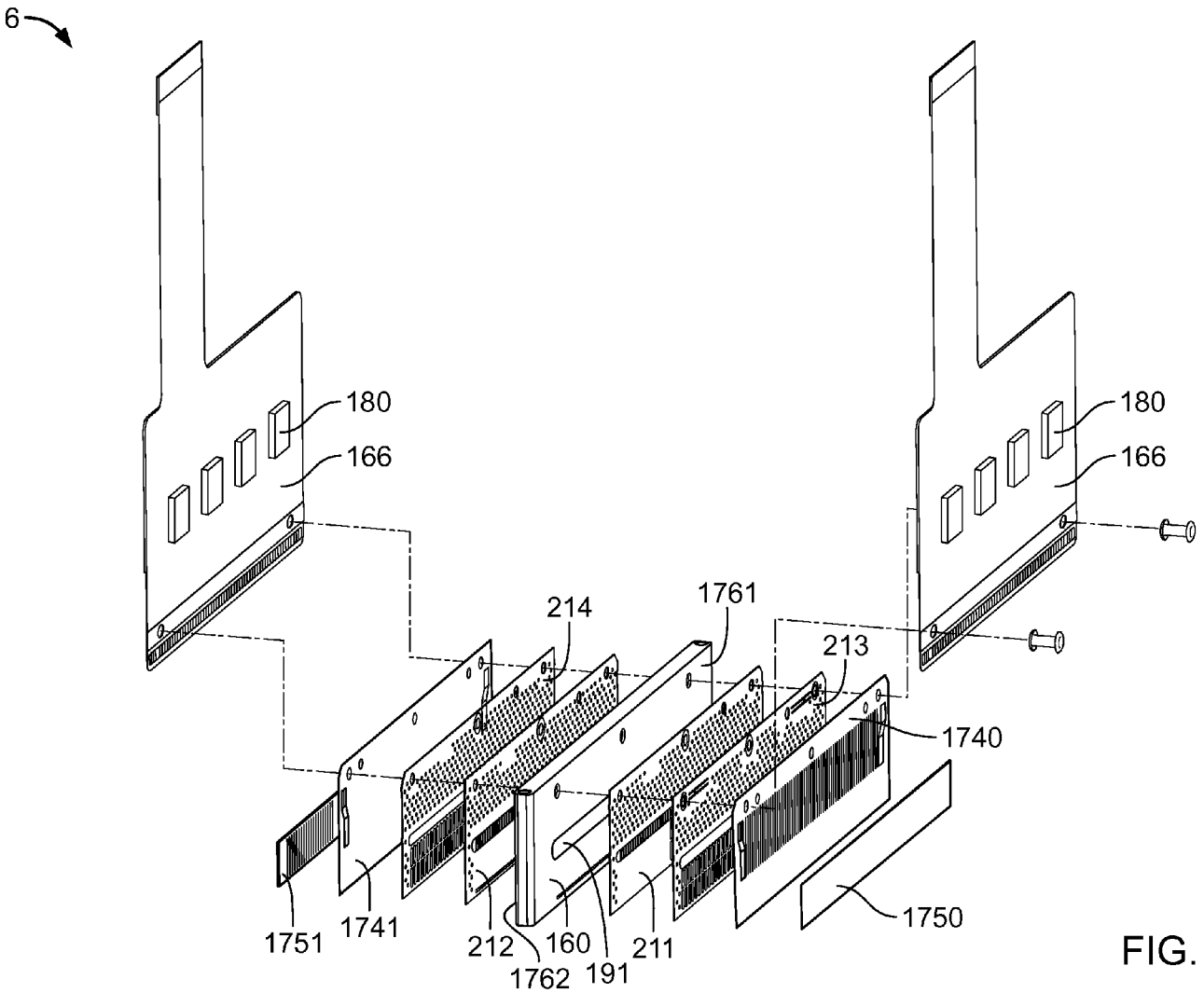
FIGS. 2A-2B are perspective and cross-sectional views of an inkjet array module.

FIG. 2A shows the inkjet array module 6 having the carbon body 160, and stiffener plates 211 and 212, cavity plates 213, 214, compliant membranes 1740, 1741, and piezoelectric elements 1750 and 1751 assembled into stacks located next to opposite sides 1761, 1762 of the carbon body 160. Four inkjet array modules 6 (i.e., 6A-6D) can be fitted within the slots 161 and 162 of the collar 14 in the nozzle plate array assembly to form a printhead assembly 100.

Figure 1D:
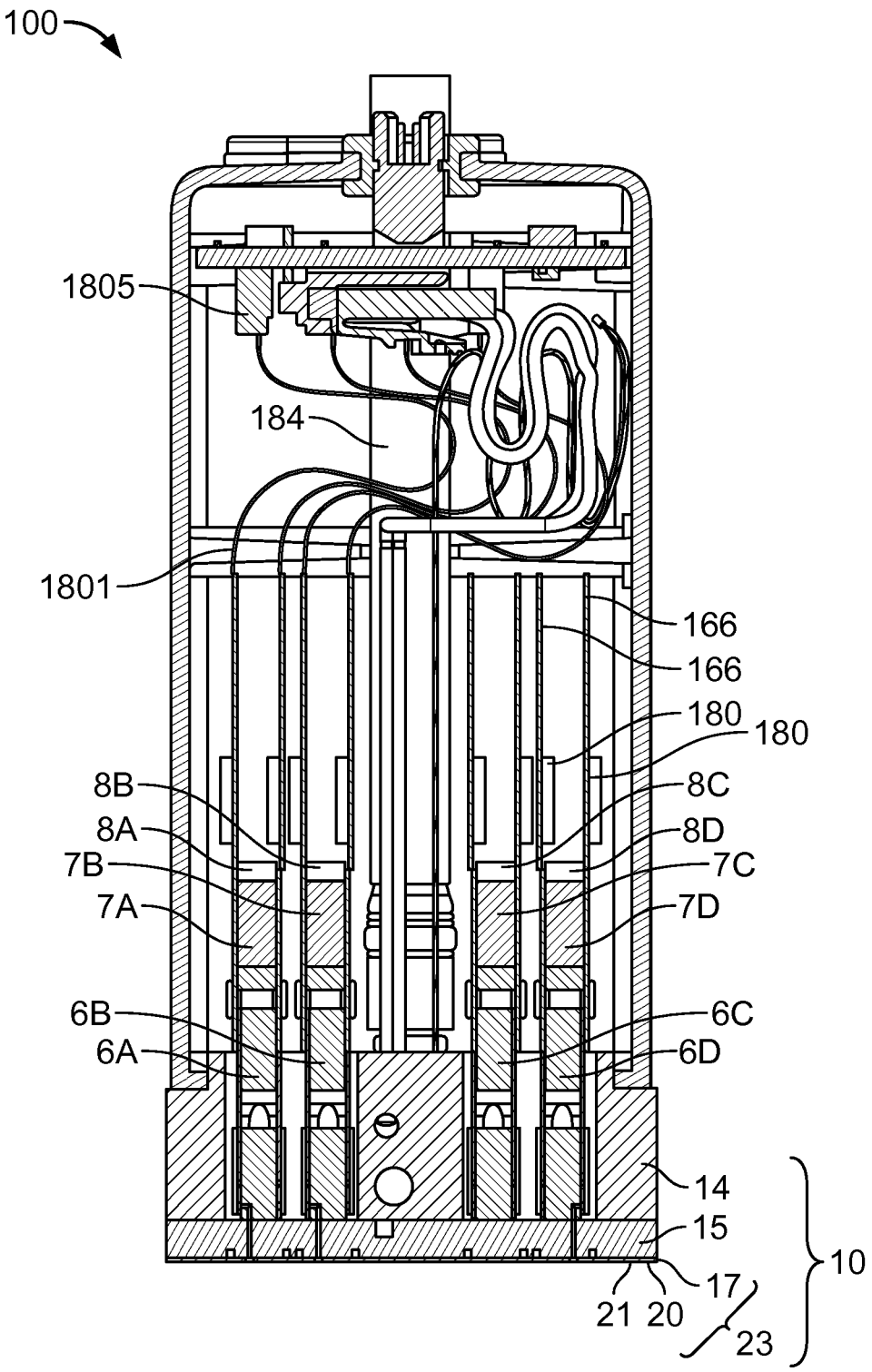
FIG. 1D is a cross-sectional view of a printhead assembly.

A cross-sectional end view of the printhead assembly 100 is shown in FIG. 1D. A vertical tube 184 in the center delivers ink to all of the inkjet array modules 6A-6D. Integrated circuits 180 are mounted on each flex circuit 166. 7A-7D are metallic clamps that run the length of the array (i.e., into and out of the plane of the drawing in FIG. 1D) with screws 8A-8D at each end of the metallic clamps 7A-7D, respectively. Flexible conductors 1801 are part of the flex circuits and are connected to connectors 1805 to enable connection to the outside world.

It is useful for the nozzle plate assembly 10 (which is a relatively less valuable component) to be easily detachable from the printhead assembly 100 in order to perform routine maintenance (e.g., cleaning or replacement) of the nozzle plate assembly 10 that can prolong the operational lifetime of the printhead assembly 100 (which is relatively more expensive). In order to enable easy detachment of the nozzle plate assembly 10 from the printhead assembly 100, the nozzle plate assembly 10 is not permanently bonded to the printhead assembly 100. Instead, the nozzle plate assembly 10 is mechanically clamped to the printhead assembly 100. A substantial clamping force 200 (shown in FIGS. 1C and 3A) in a direction perpendicular to the surface 1510 of the integrated recirculation manifold 15 is required to achieve a good mechanical seal between the nozzle plate assembly 10 and the inkjet modules 6A-6D. However, such a clamping force cannot be evenly transmitted at all locations along the carbon body 160, through the carbon body 160 of the inkjet modules 6A-6D to the nozzle plate assembly 10. This is due to a decrease in mechanical stiffness of the carbon body 160 along part 2101 of its length 210 (shown in FIG. 3A) caused by the presence of a hollow ink refill chamber 191 defined in the middle of the carbon body 160. The hollow ink refill chamber would allow the carbon body to distort in the presence of a uniform force applied along the length of the top of the carbon body 160, making it difficult to transmit the applied force uniformly along all positions at the bottom of the carbon body 160.

Figure 4A:
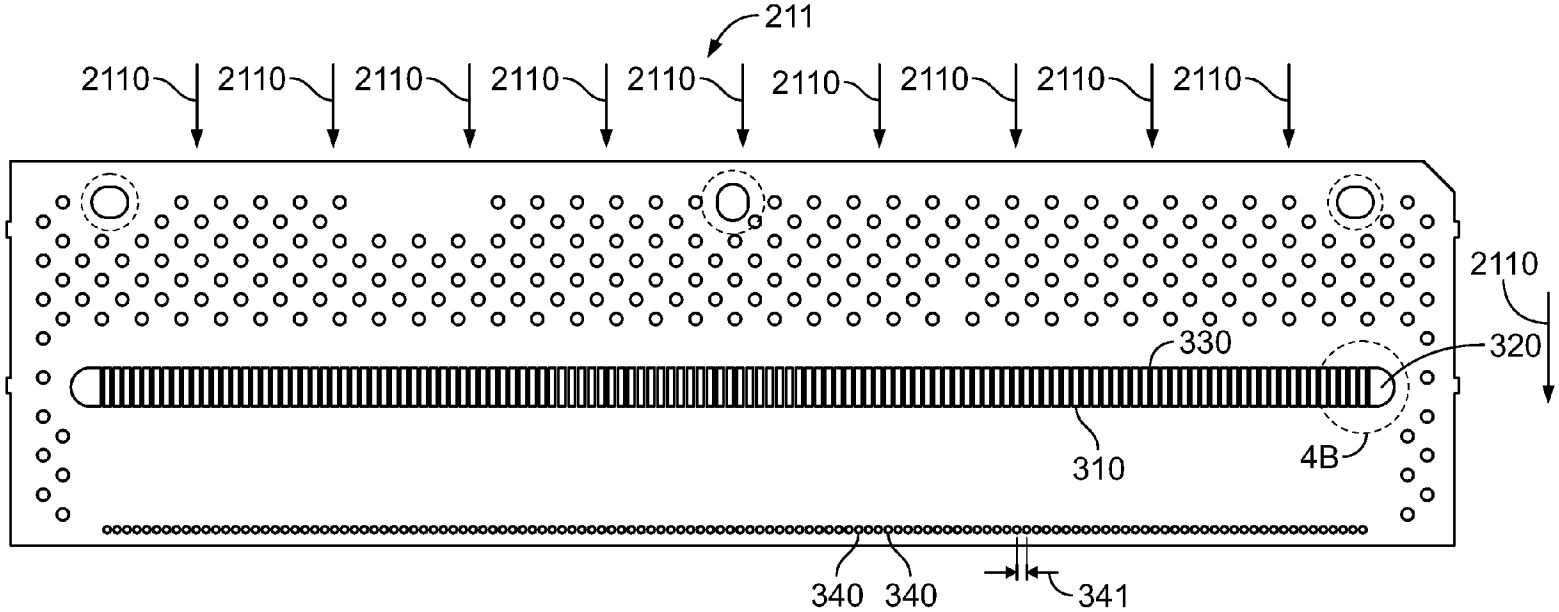
FIGS. 4A-4B are top views of a stiffener plate.

To improve the evenness of the transmission of forces 169 from a top portion 161 of the carbon body 160 to forces 1691 at the bottom of the carbon body 160 towards the nozzle plate assembly 10, two stainless steel stiffener plates 211 and 212 that are attached to and sandwich the carbon body 160 between them have a uniform series of stainless steel posts 330 (shown in FIGS. 4A and 4B) fabricated in a long hollow channel 320 adjacent to the ink refill chamber 191. The posts provide stiffness on both sides of the ink refill chamber to stiffen the carbon body 160, reduce the deformation of the carbon body, and enable it to transmit the clamping forces evenly from the top to bottom. In other words, the posts provide mechanical support to the carbon body 160 having a hollow ink refill chamber 191 in a direction orthogonal to a length of the hollow ink refill chamber; such that the clamping force 200 secures the carbon body 160 to the nozzle plate assembly 10 positioned along the direction and under the carbon body 160.

Figure 4B:
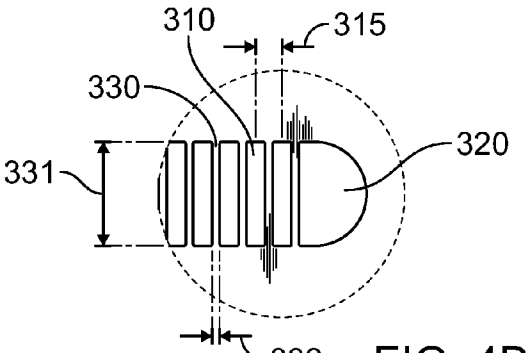
Figure 4C:
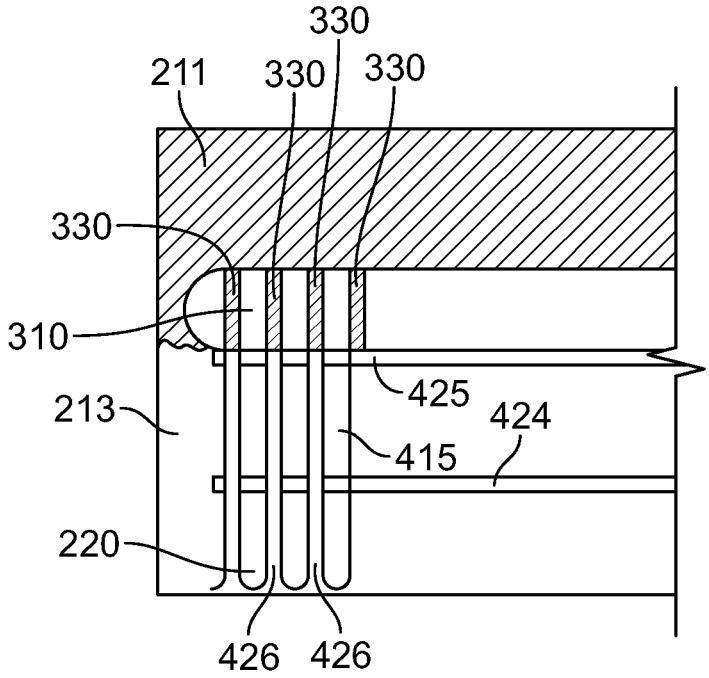
FIGS. 4C and 4D is a perspective views of overlapped stiffener plate and cavity plate.

The series of posts 330 define a corresponding series of hollow channels 310 in each of the stiffener plates 211, adjacent to the ink refill chamber 191 of the carbon body 160. These posts 330 and hollow channels 310 are also aligned between respective inkjet pumping chamber inlets 415 in the cavity plate 213. In FIG. 4C, the stiffener plate 211 lies above and overlaps the cavity plate 213. The bottom half of the stiffener plate 211 is removed to show the underlying features on the cavity plate 213. The posts 330 in the stiffener plate 211 line up with lands 426, which separate two pumping chambers 220, in the cavity plate 213. The hollow channels 310 in the stiffener plate 211 are also lined up with the pumping chambers 220 in the cavity plate 213 to ensure that ink flows from the ink refill chamber 191 through the hollow channels 310 and into the pumping chambers 220. When the carbon body 160 and the stiffener plates 211 and 212 are mechanically bonded together using an epoxy, the series of posts 330 in the stiffener plates 211 provide the needed mechanical stiffness in the direction marked with an arrow 2110.

The distance between the centers of hollow channels 310 in the stiffener plates 211 and 212 is equivalent to the width of a gap 315, which is also equal to a spacing between nozzle openings 250 in the nozzle plate 21. The spacing between nozzle openings 250 in the nozzle plate 21 is the same as the spacing 341 between openings 340 in the stiffener plates. The dimensions of the hollow channels 310 between the posts 330 help to maintain a good volume of flow from the ink refill chamber 191 into each of the pumping chambers of 220 in the cavity plate 213 and 214 while the dimensions of the posts provide mechanical stiffness in the direction marked with arrow 2110. The flow of ink leaves the ink refill chamber 191 and enters the stiffener plate through the hollow channels 310 between a pair of posts 330. The dimensions of the posts also ensure that fluid resistance experienced by ink flowing out from the ink refill chamber through the hollow channels 310 is not too large such that the flow of ink from the ink refill chamber into the cavity plate is impeded.

Figure 2B:
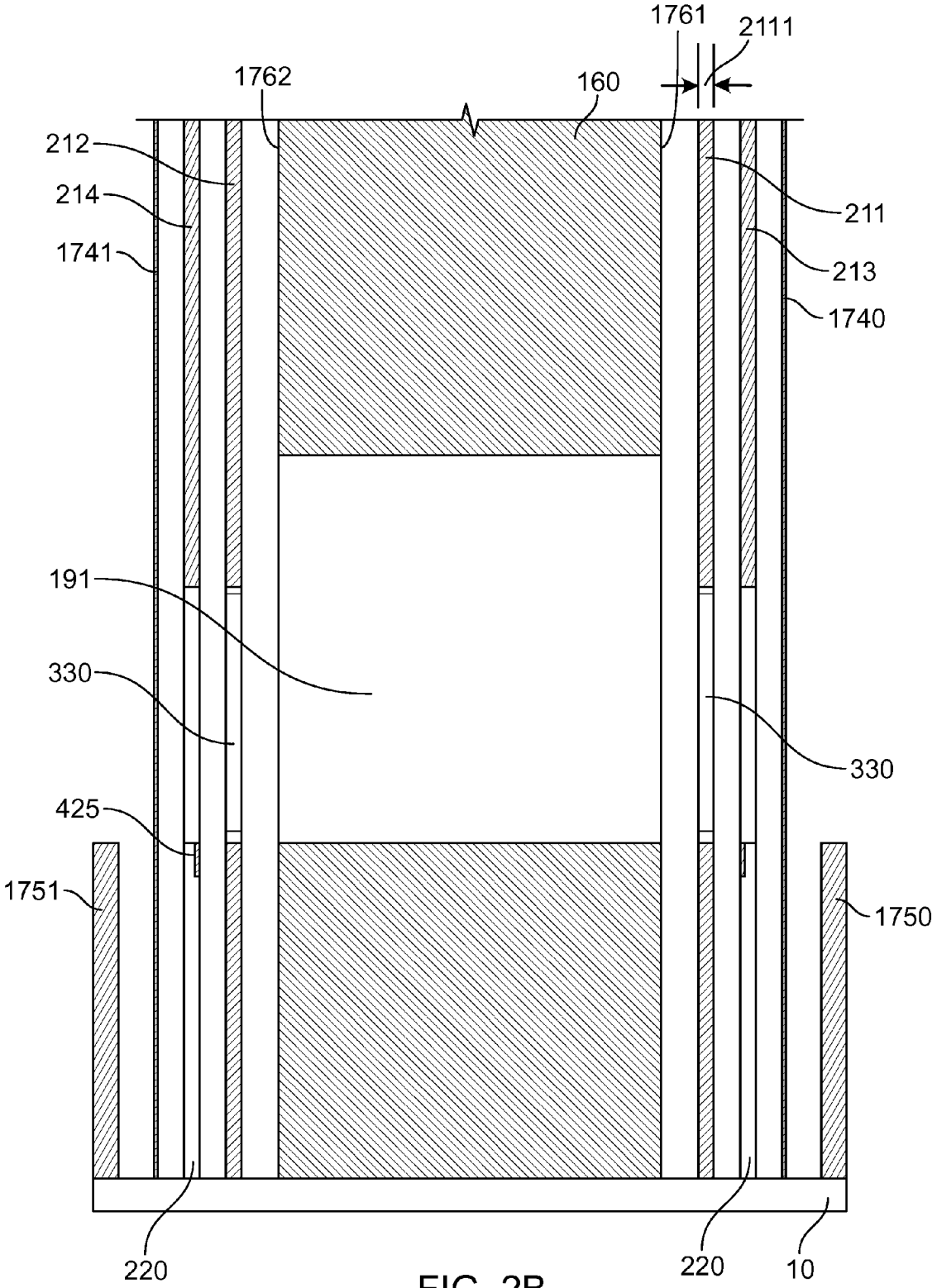

The stiffener plate 211 can have a thickness 2111 (shown in FIG. 2B) of about 50 microns to 150 microns (for example, 127 microns). As shown in FIG. 4B, a height 331 of the posts 330 can be, for example, less than about 4 mm, 3 mm, 2 mm, and/or greater than about 500 microns, 1 mm. A width 332 of the posts 330 can be for example, less than about 250 microns, 200 microns, 150 microns, 130 microns, and/or greater than about 100 microns, or 120 microns. The gap 315, between the centers of two adjacent hollow channels 310 can be less than about 700 microns, 600 microns, 508 microns, and/or greater than about 350 microns, 450 microns, or 500 microns.

Figure 5A:
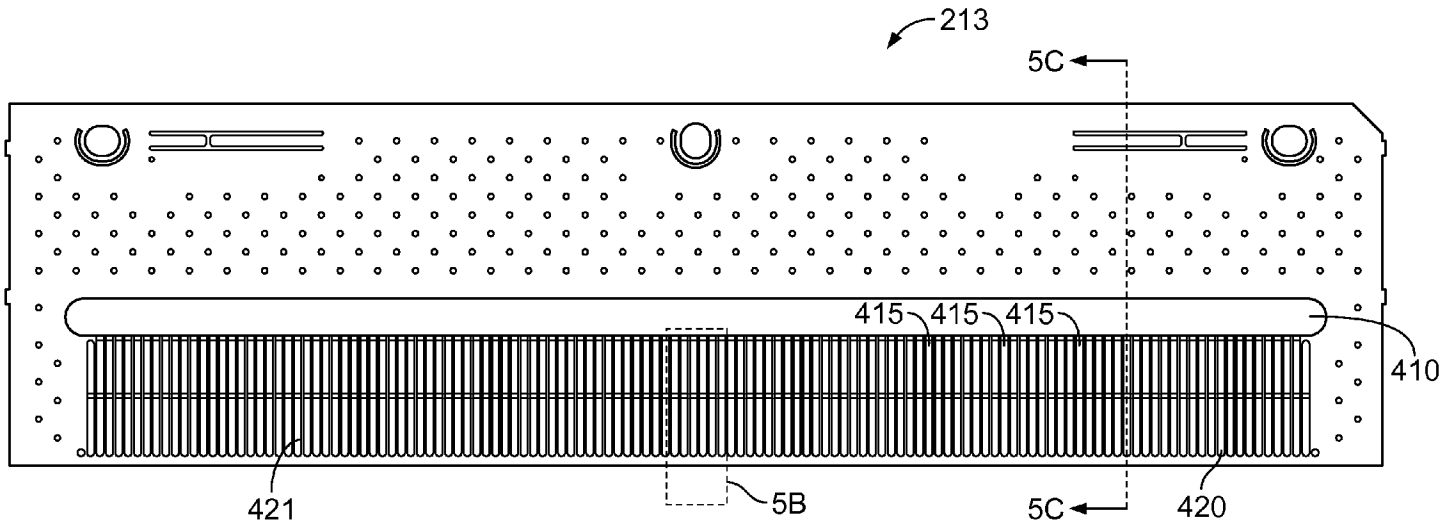
FIGS. 5A-5B are top views of a cavity plate.
Figure 5C:
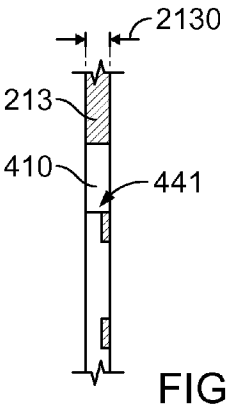
FIG. 5C is a cross-sectional view of the cavity plate.
Figure 5B:
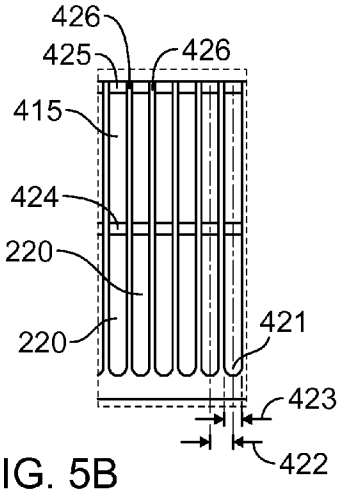

FIG. 5B shows a magnified view of the pumping chambers 220 defined in the cavity plate 213. The cavity plate 213 can have a thickness 2130 (shown in FIG. 5C) of about 50 to 150 microns (for example, 127 microns). A width 423 of the hollow pumping chambers 220 can be, for example, less than about 500 microns, 400 microns, 388 microns, and/or greater than about 250 microns, 300 microns, or 350 microns. A spacing 422 between the centers of two hollow pumping chambers 220 can be, for example, less than about 700 microns, 600 microns, 508 microns, and/or greater than about 400 microns, or 500 microns.

Ribs 424 and 425 each has about half the thickness of the cavity plate 213 and provides structural support, allowing the cavity plate 213 to be handled during assembly without damage to lands 426, which are areas between pumping chambers 220. The lands 426, being narrow and thin, are fragile and vulnerable to bending, folding, or breaking before covers are mounted on the cavity plate 213, which can then provide additional support. Covers are attached to each surface of the cavity plate 213 to form pumping chambers. The covers include compliant membranes 1740 and 1741 and the stiffener plates 211 and 212. Due to the narrowness of lands 426, the jetting assembly that includes the cavity plate 213 can therefore have a higher nozzle pitch and produce high resolution images. The dimensions of lands 426 can be, for example, less about 300 microns, 200 microns, 150 microns, 120 microns, and/or greater than 75 microns, or 100 microns. Further description is provided in U.S. Pat. No. 8,091,988, the entire content of which is incorporated herein by reference.

Figure 4D:
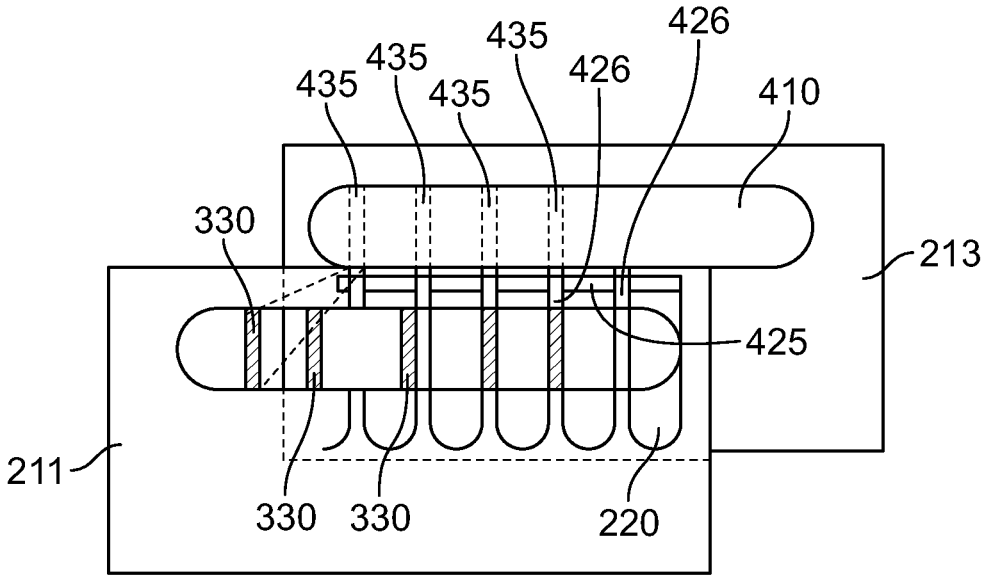

The posts 330 in the stiffener plate 211 are dimensioned to align with an (imaginary) extension 435 (FIG. 4D) in the ink refill passage 410 of the cavity plate 213, the extension 435 being directly above the lands 426 between different pumping chambers 220.

Two compliant membranes 1740 and 1741 that are parallel to the stiffener plates 211 and 212 are spaced by a distance not smaller than 118 micron (greater than 120 micron, greater than 150 micron, greater than 250 microns, and/or smaller than 400 microns, smaller than 300 microns) from the stiffener plates 211 and 212, respectively, to handle the acoustic waves propagated in the ink properly by not contacting the posts 330 when the membranes are being deflected during operation. The compliant membranes help to reduce crosstalk between the pumping chambers 220.

Figure 2C:
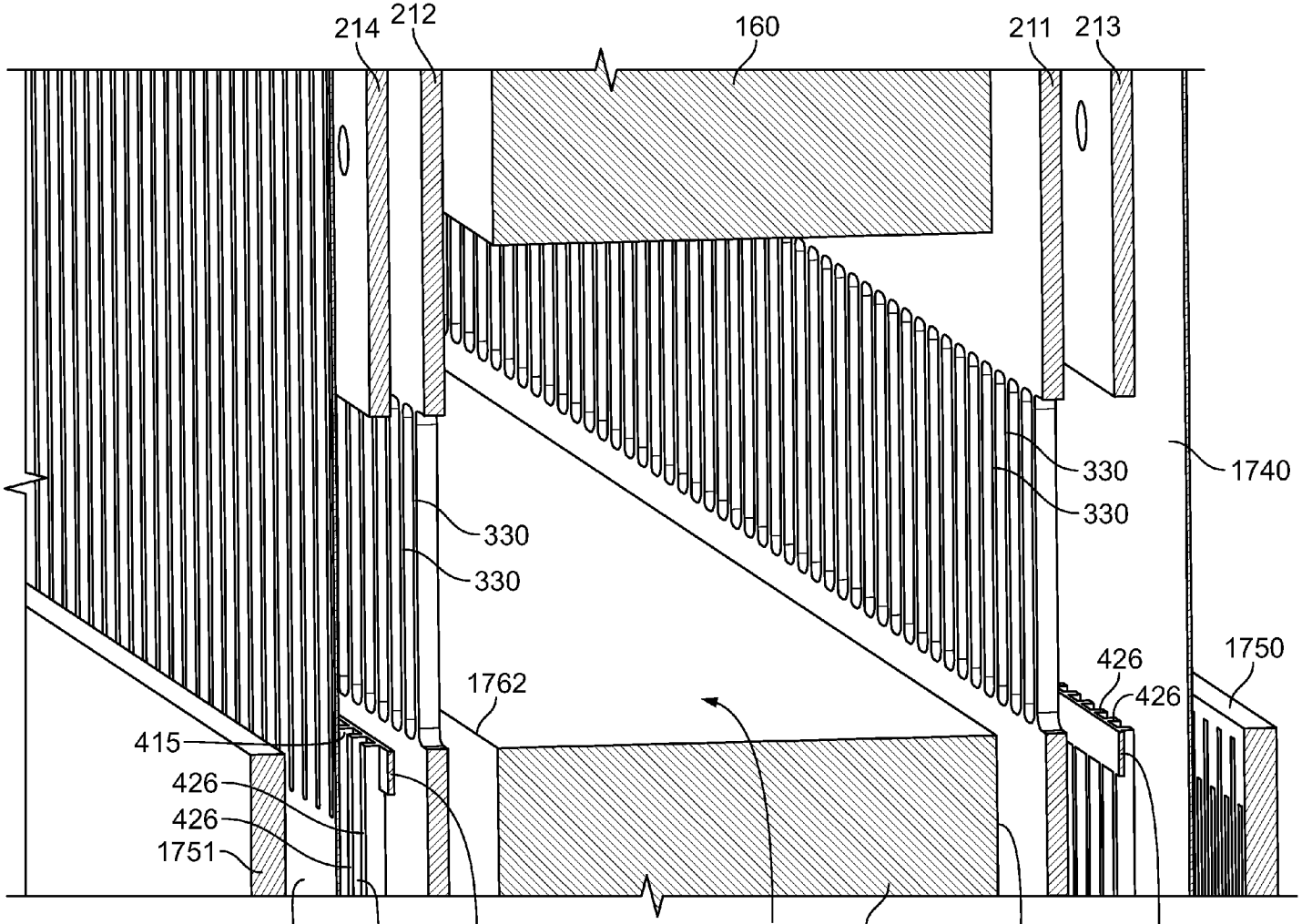
FIG. 2C is a perspective magnified view of an inkjet array module.

FIG. 2C shows a perspective magnified view of the inkjet array module 6. The posts 330 are stacked on the opposite faces 1761 and 1762 of the carbon body 160 to stiffen the carbon body along the hollow ink refill chamber 191. The cavity plates 213 and 214 contain ribs 425 for structural support, as outlined above. Ink from the hollow ink refill chamber 191 flows between the posts 330 and enters the pumping chamber 220 through the pumping chamber inlet 415. The compliant membranes 1740 and 1741 are stacked between the cavity plates and the piezoelectric elements 1750 and 1751.

In one specific example, the following dimensions can be used for the parts discussed in the previous paragraph: the compliant membranes are each 25 micron thick, the stiffener plates and the cavity plates are each 127 micron thick, the posts 330 are 130 microns wide, 127 microns thick and 2 mm tall.

Crosstalk is unwanted fluidic interaction between ink flowing in and jetted from separate jets. A jet generally refers to the pumping chamber, the piezoelectric element, the fluid path to a nozzle, and the nozzle from which ink is ejected. Typically, it is desirable that there be no crosstalk between jets. When crosstalk is present, the firing of one or more jets may influence the performance of other jets by altering ink ejection velocities or the drop volumes jetted, for example. This can occur when unwanted energy is transmitted between jets. During operation of the inkjet module 6, the piezoelectric elements 1750 and 1751 (e.g., PZT) expand and flex the compliant membranes 1740 and 1741, which are attached to the piezoelectric elements. This in turns causes the compliant membranes to pull away from the cavity plates 213 and 214, creating low pressure regions in the pumping chambers 220 due to the increase in volume of the pumping chambers, which causes ink 170 in the refill chamber 191 to be drawn into them, across the hollow channels 310 in the stiffener plates 211 and 212, and into the ink fill passages 410 in the cavity plates 212 and 213.

The increase in volume in the pumping chamber also causes the ink already present in the pumping chamber to launch a negative pressure wave which contains acoustic energy. This negative pressure starts in the pumping chamber and travels toward both ends of the pumping chamber 220 (towards an end 421 of the pumping chamber 220 and towards an ink fill passage 410 above the pumping chamber inlet 415). When the negative wave reaches the end of the pumping chamber and encounters the large area of the ink fill passage 410 (which can be approximated to a free surface), the negative wave is reflected back into the pumping chamber 220 as a positive wave, travelling towards the end 421 of the pumping chamber 220. The effect of providing an ink fill passage with the equivalent of a free surface 441 (shown in FIG. 5C) is that more energy is reflected back into the pumping chamber at the pumping chamber inlet 415, and less energy enters the ink fill passage 410 where the energy could travel down other pumping chambers and affect the performance of neighboring jets. Moreover, reflecting acoustic energy back into the pumping chamber 220 increases the pressure at the end 421 of the pumping chamber for a given applied voltage.

The compliance of the membranes 1740 and 1741 over the ink fill passage 410 also reduces crosstalk between jets by reducing the amplitude of pressure waves that enter the ink fill passage from firing jets. The compliant membrane 1740 and 1741 can for example, be a film of polyimide having a thickness of less than about 100 microns, 50 microns, 25 microns, and/or a thickness greater than about 10 microns, or 20 microns. In general, the more compliant (or less constrained) the membrane is, the better it reflects the negative pressure wave and attenuates any waste acoustic energy that may otherwise enter neighboring pumping chambers. The placement of the posts 330 in the stiffener plate 211 ensures that the compliant membrane can deflect sufficiently towards the cavity plate 223 and not be obstructed by the presence of posts 330. In other words, during the operation of the printhead assembly 100, the compliant membranes 1740 and 1741 do not contact the stiffener posts 330.

After the piezoelectric element is held in the expanded state for a period of time, the piezoelectric element 1750 is deactuated so that it returns to its original position. The returning of the piezoelectric element to its original position creates a positive wave in the ink in the pumping chamber. The timing of the deactuation of the piezoelectric element is selected so that its positive wave and the reflected positive wave are additive when they reach the end 421 of the pumping chamber. This is discussed in U.S. Pat. No. 4,891,654, the entire content of which is incorporated herein by reference.

From the end 421 of the pumping chamber 220, the ink leaves the pumping chamber 220 and is then pushed towards openings 340 defined in the stiffener plate 211 before entering the orifices 1641 in the carbon body 160. The ink then negotiates the 90 degree bend of the descender 192 in the carbon body 160 and emerges from the carbon body 160 along the edge 1640 through orifices 1642 before continuing on the fluid path that leads to nozzle openings 250 in the nozzle plate 21. Ink is the ejected from the printhead assembly 100 and gets deposited on a printing medium.

Figure 6A:
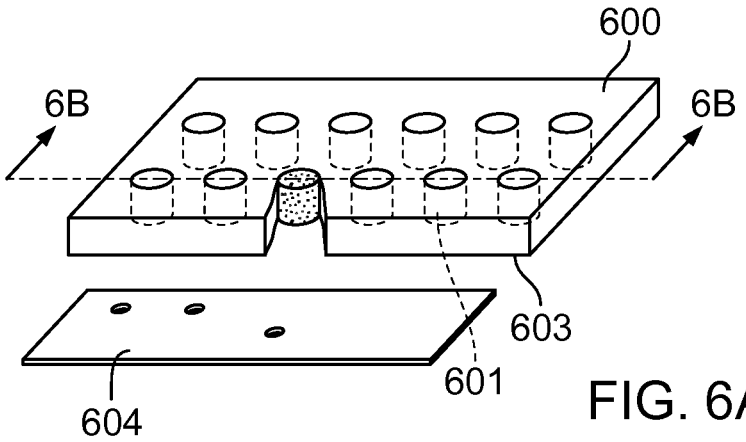
FIGS. 6A and 6B are schematic perspective views of a nozzle plate.

As shown in FIG. 6A, a nozzle plate 600 has nozzle openings 601. The nozzle plate 600 has an exposed surface 603 that faces a printing medium 604; each of the nozzle openings is at the exposed surface 603, and ink droplets from each jet are ejected from the nozzle opening toward a substrate during printing.

Figure 6B:
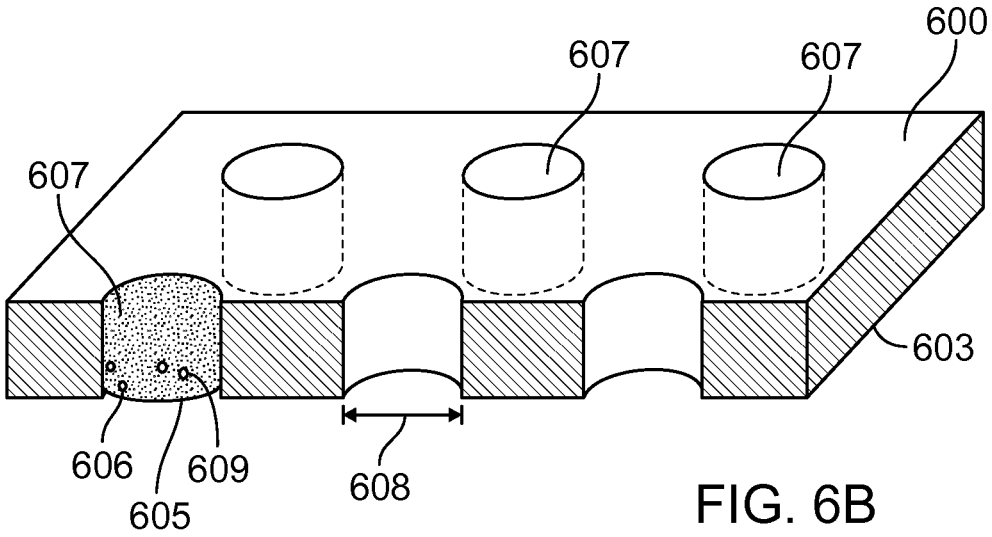

As shown in FIG. 6B, the nozzle opening for each jet lies at the end of a nozzle tube 607 in a nozzle plate 600. At times when ink droplets are not being ejected from the nozzle opening, ink is held in the nozzle tube to prepare the nozzle for subsequent jetting of droplets. The ink in the nozzle tube then forms a meniscus 605 of ink 170 to define a liquid-air interface 606 within the nozzle tube 607 The meniscus 605 may have an outer rim 691 at the nozzle opening and a concave surface 693 caused by a negative pressure applied to the ink 170 upstream of the nozzle to keep it from leaking from the nozzle opening. (We often use the term nozzle interchangeably with the term nozzle tube.) The meniscus 605 extends over the diameter 608 of the nozzle opening 601 and is positioned within the nozzle tube 607 of the nozzle opening 601, away from the exposed surface 603. The ink, which can include pigments and solvents, may dry or undergo other changes in its characteristics at the nozzle opening 601 and within the nozzle tube, for example, when volatile solvents 609 evaporate from the ink through the liquid-air interface 606 of the meniscus 605. Ink that is held in and flows through various parts of the inkjet array module is also subject to settling of pigments and to other changes in characteristics that can adversely impact the quality of the printing and the maintenance of the inkjet array module. To reduce these effects, ink can be recirculated continuously while the inkjet array module is in operation or in an idle state. For this purpose, recirculation can be carried out, for example, at a refill chamber 191 (FIG. 7E) of an inkjet array module 16A (FIG. 7E), upstream of individual pumping chambers 220. Several inkjet array modules can be installed in a printhead assembly 10.

The refill chamber 191 houses a larger volume of ink 170 compared to the ink contained in individual pumping chambers 220. Recirculating ink at the refill chamber 191 helps to prevent heavier pigments of inks 170 from settling there. Recirculating at the refill chamber 191 helps to ensure that ink having specific characteristics (for example, viscosity, temperature, amount of dissolved gases) is delivered to individual pumping chambers 220 for jetting. In addition, a deaerator can be arranged upstream of the refill chamber to remove gases from the ink supplied to the refill chamber 191. In that way, inks having very low dissolved gas content can be supplied to pumping chambers 220 for jetting. Recirculating ink 170 at the refill chamber 191 also facilitates changing of inks because the refill chamber recirculation flow paths provide a fluid path for the ink 170 in the refill chamber 191 to be actively removed (using back pressure exerted from an external source 120) from the printhead assembly 10 in order for new inks to be introduced to the printhead assembly 10. In the absence of the recirculation fluid paths, a particular ink would need to be flushed from the nozzles 249 before new ink can be introduced to the printhead assembly 10 (assuming that the printhead assembly 10 is not disassembled between changes of ink). Recirculation of ink also helps with priming and recovery. An empty printhead containing air can be primed by introducing a jetting fluid into the printhead such that a meniscus of the jetting fluid is formed at one or more nozzles of the printhead. Priming generally refers to the preparation of a meniscus at the nozzle.

In addition to recirculating ink at the refill chamber, recirculating ink 170 that is being held in and upstream of the nozzle 249 from which ink droplets are to be ejected helps to ensure that fresh ink, of the same characteristics (e.g., viscosity, temperature, and solvent content) as the ink that is in the refill chamber 191 is held in the nozzle 249, for example, during the time when ink is not actually being jetted. Recirculation helps to ensure that, for example, the first droplet jetted from the nozzle opening 250 after a period of no jetting is of the same quality, size, and characteristics as other droplets that are jetted before and after the period of no jetting. This allows for better jetting performance.

For example, inks that contain volatile solvents may be dried out within the nozzle 249 when the meniscus 605 of the ink 170 at the ink-air interface 606 loses the volatile solvents 609 at the interface to the atmosphere, in the absence of recirculation. Some inks may absorb air through the ink-air interface 606 at the meniscus 605 when the ink is exposed to air. This absorption may cause bubble formation within the printhead assembly 10 that can render the printhead inoperable when these bubbles are trapped in ink passages in the printhead assembly 10.

To recirculate ink that is held in the nozzle tube at times when the inkjet is not ejecting droplets from the nozzle opening can be done by providing a recirculation path that opens at one end into the nozzle tube and leads at its other end to a recirculation supply of ink. We describe such nozzle recirculation paths below. Note that, as shown in FIG. 6B, the nozzle tube 607 includes not only the segment that lies within the nozzle plate but also a collinear segment within a nozzle recirculation plate 20, and at least part of the nozzle recirculation path is provided in the nozzle recirculation plate, as described in more detail below.

Providing such recirculation paths from the nozzle tubes is not trivial due to space constraints in body in which the nozzles are formed. The inclusion of recirculation paths to closely spaced nozzles may also create cross talk between jets (explained in more detail below). Recirculation may also reduce efficiency of the jetting, because it draws some ink from the nozzle tube and reduces the ink pressure in the nozzle tube, which can reduce the amount of jetting fluid that is being ejected in a droplet from the nozzle opening onto the printing substrate. The recirculation flow also may perturb the meniscus pressure at the nozzle leading to a heightened sensitivity of the nozzle to the fluctuations in the recirculation pressure.

Ink flows at a nominal flow rate as it is ejected through each of the nozzle onto a substrate. Ink is held under a nominal negative pressure associated with a characteristic of a meniscus of the ink in the nozzle when ejection of ink from the nozzle is not occurring. Each flow path having a nozzle end at which it opens into one of the nozzles and another location spaced from the nozzle end that is to be subjected to a recirculation pressure lower than the nominal negative pressure so that ink is recirculated from the nozzle through the flow path at a recirculation flow rate. Each recirculation flow path has a fluidic resistance between the nozzle end and the other location such that a recirculation pressure at the nozzle end of the flow path that results from the recirculation pressure applied at the other location of the flow path is small enough so that any reduction in flow rate below the nominal flow rate when ink is being ejected is less than a threshold, or a change in the nominal negative pressure when ink is not being ejected is less than a threshold, or both.

In some inkjet heads, the ink 170 is split into two paths in a recirculation structure immediately upstream of the nozzle plate 21. One of the paths conducts the ink to the nozzle plate 21, from which ink is ejected. The other path provides a path for the ink to flow out of the printhead assembly 10 into an external ink reservoir 110.

A recirculation flow rate for recirculation flow paths for nozzles of ink jets of an inkjet assembly is selected and a maximum external pressure to be applied to the recirculation flow paths is selected. A refill resistor having fluidic resistances to provide a fluid flow rate from the refill resistor that is similar to a sum of nozzle recirculation flow rates for the nozzles is designed. A portion of a fluid in a nozzle of an inkjet of an inkjet assembly flows from the nozzle through a recirculation path to a reservoir separate from the inkjet assembly.

Figure 7A:
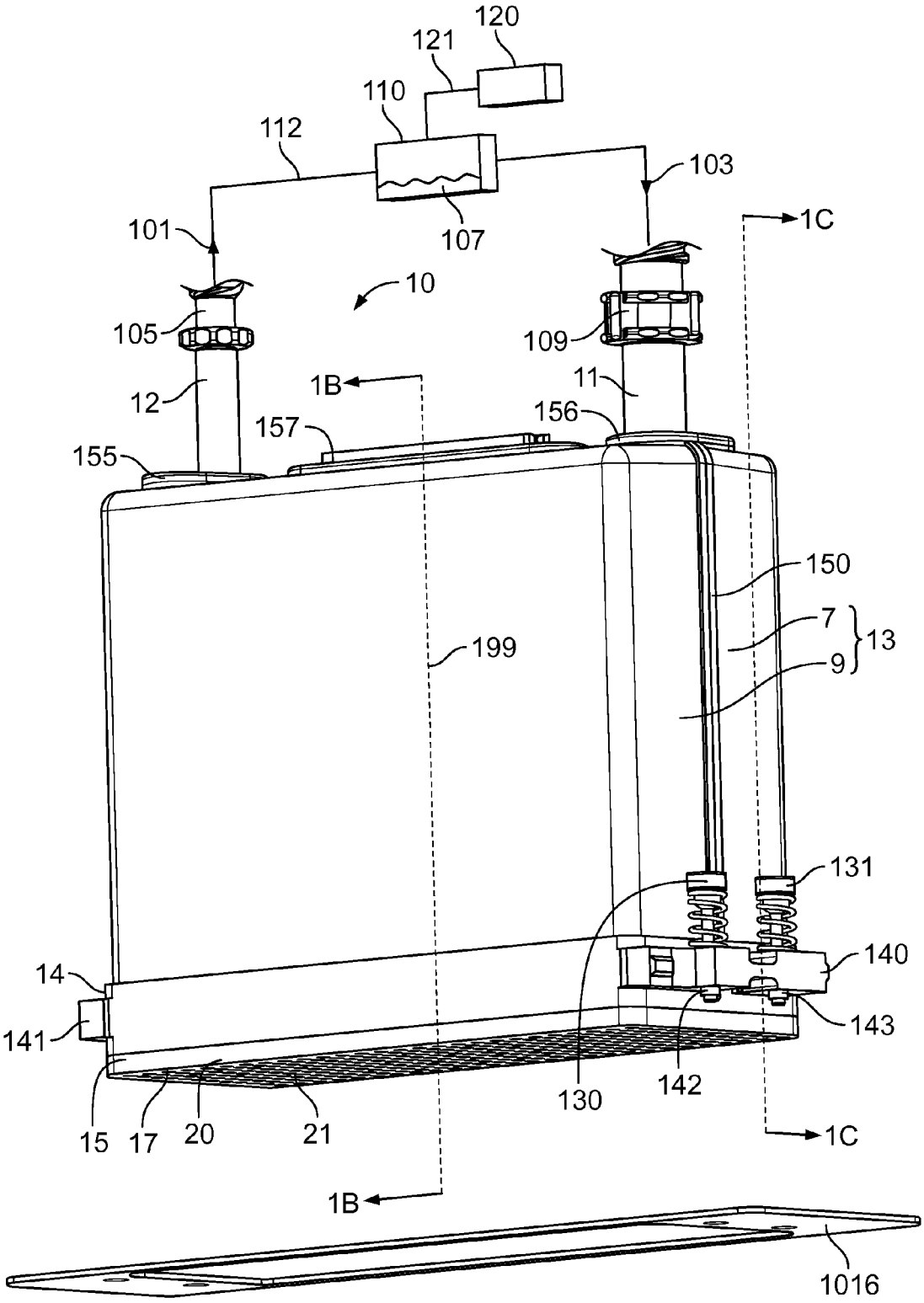
FIGS. 7A-7C show isometric views of a printhead assembly.

In FIG. 7A, an inkjet printhead assembly 10 has an ink inlet 11, and an ink outlet 12. The ink inlet 11 is connected to an external ink reservoir 110 through a tubing coupler 109 and piping 111 so that the ink reservoir 110 supplies ink 107 to the ink inlet 11 (in the direction indicated by arrow 103). The external ink reservoir 110 is also connected to the ink outlet 12 through a tubing coupler 105 and piping 112 and receives returned ink from the ink outlet 12 (in the direction indicated by arrow 101). The external ink reservoir 110 is connected to a vacuum source 120 through vacuum connections 121. The vacuum source 120 can exert a vacuum pressure on the ink in the ink reservoir 110.

The printhead assembly 10 includes a rigid housing 13 formed of two half-pieces 9 and 7, which (when assembled) encapsulate components of the printhead assembly 10. Examples of materials from which the two half-pieces of rigid housing 13 can be made include thermoplastics. The ink inlet 11 enters the housing 13 through a ring-shaped resilient support 156 that is captured in a round aperture 1001 formed on the upper wall of the housing 13 when the two half-pieces are mated.

Similarly, the ink outlet 12 leaves the housing 13 through a resilient ring support 155 that is captured in a round aperture 1004 formed in the upper wall of the housing 13 when the two half-pieces are mated. The bottom 1006 of the housing 13 has an inwardly projecting rim 1008 on both ends that mates with corresponding grooves 1010 on opposite ends of a collar 14. The integrated recirculation manifold 15 is a separate piece from the collar, and integrates the flow paths of two recirculation systems. Details of the recirculation systems are described below.

The collar 14, the integrated recirculation manifold 15, the descender plate 17, the nozzle recirculation plate 20 and the nozzle plate 21 jointly form a nozzle plate assembly 221.

The housing 13 can be opened into two halves along a seam 150. A multiple-contact electrical connector 157 at the top of the assembly can receive a mating connector of a signal cable to enable signals to be carried to and from actuation elements of the printhead assembly used to trigger jetting of ink from each inkjet, for example. Using the three mounting screws, the tubing couplings 105 and 109, and the electrical connector 157, the entire printhead assembly can be easily removed as a stand-alone assembly from the print bar 1016, for maintenance, storage, or replacement.

Figure 7B:
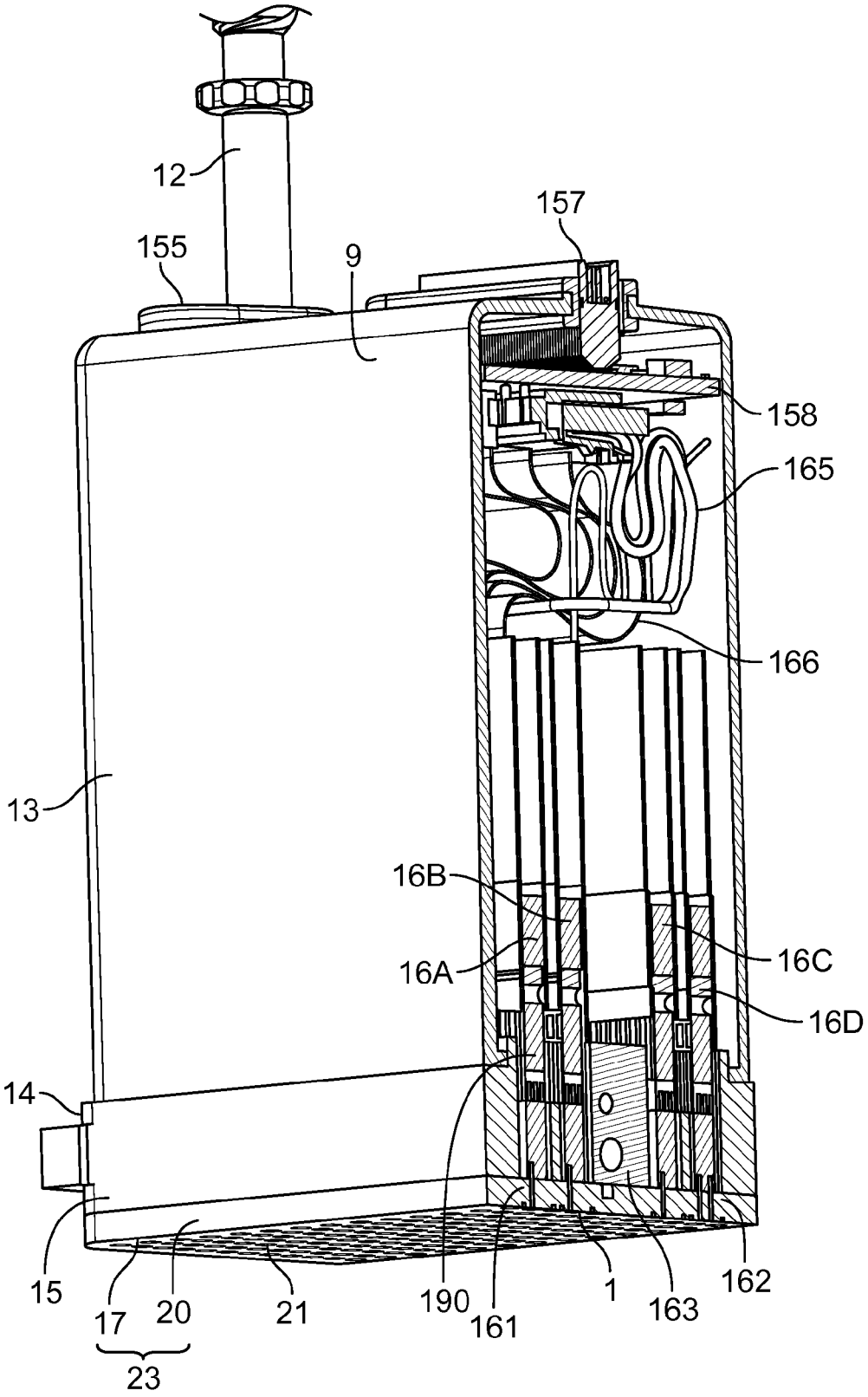

As shown in FIG. 7B, within the printhead assembly four inkjet array modules 16A-16D are arranged in two pairs, each pair mounted in corresponding long rectangular slots 161 and 162 in the collar 14. Each array module includes two flexible circuits 166 that are connected to circuitries mounted on a circuit board 158 supported within the housing 13. A heater wire 195 is optionally included in some printhead assembly 10. The heater wire 195 can be used to heat up the ink 107 that is supplied into each of the inkjet array modules 16A-16D.

Figure 7C:
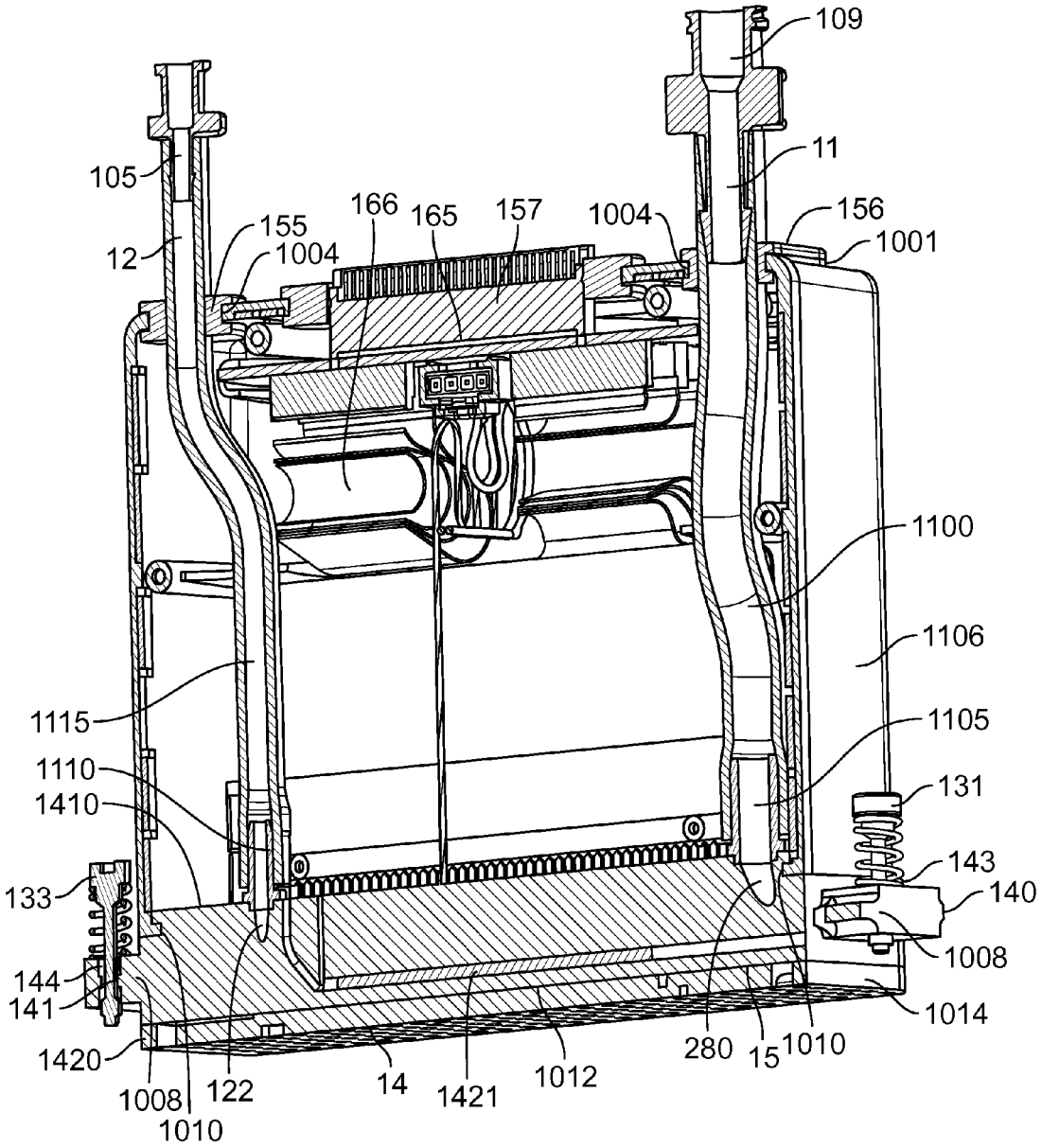

The ink inlet 11 is connected, as shown in FIG. 7C, to the collar 14 at a throughhole 280 in the wall 163 by way of a piping 1100 and a coupler 1105. The ink outlet 12 is connected to the collar 14 at a throughhole 122 in the wall 163 of the collar 14 through a coupler 1110 and a piping 1115. A second return 1421 from the recirculation manifold is formed as a horizontal channel in the collar 14. The four pairs of flexible circuits 166 are connected to electronic circuitries 171 arranged on the board 158.

Figure 7D:
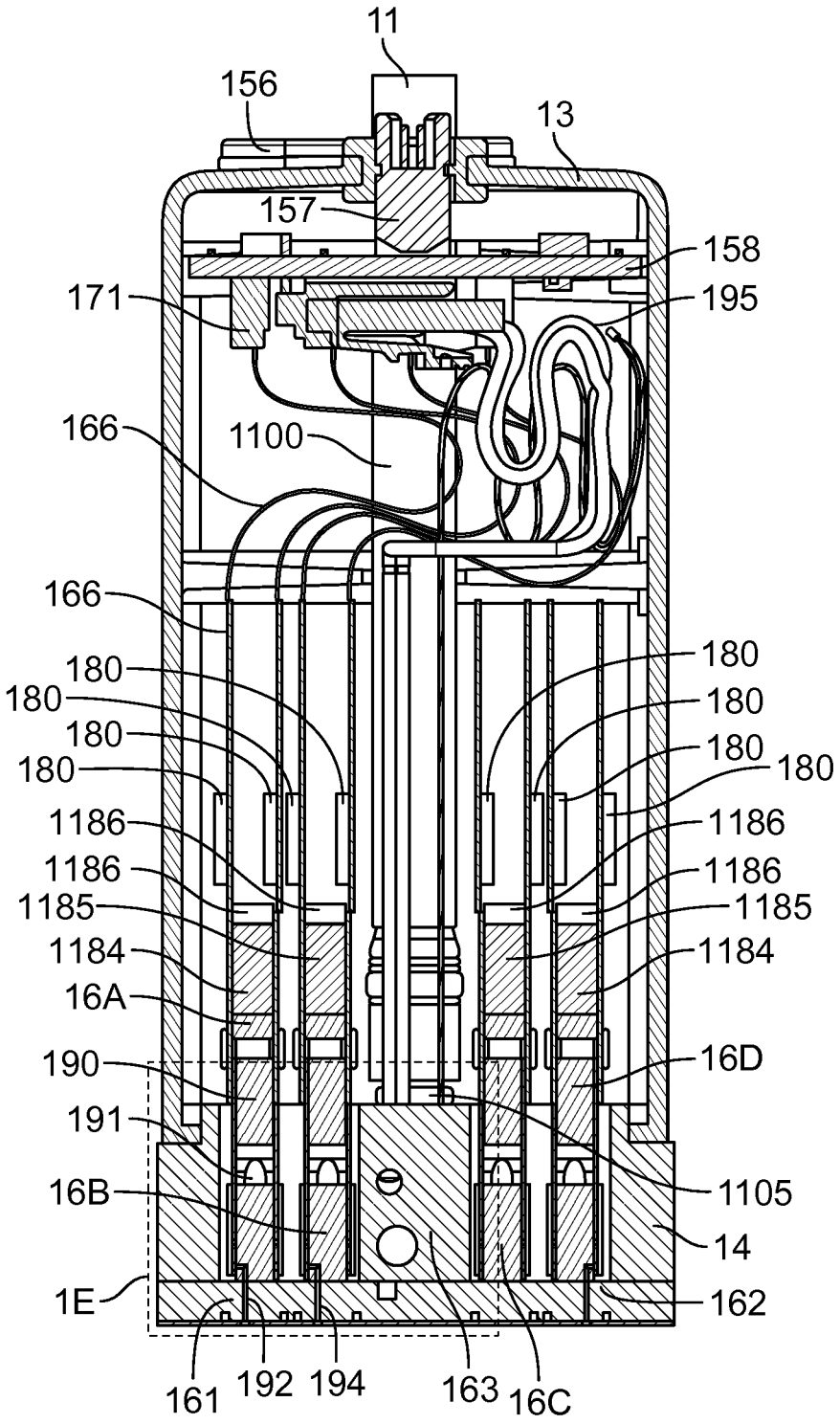
FIGS. 7D-7H are views of a printhead assembly.

FIG. 7D shows a cross-sectional end view of the printhead assembly 10. Aluminum clamps 1184 span the length of each of the inkjet array modules 16A-16D (into and out of the plane of the drawing). There is a screw 1185 at each end of the aluminum clamp 1184, the screw having a screw head 1186 positioned above the clamp 1184. Each of the array modules 16A-16D includes a carbon body 190, in which a refill chamber 191 is defined. All four refill chambers 191 for the array modules 16A-16D are fluidically connected. The carbon body 190 is sandwiched between stiffener plates 210, 211 and cavity plates 212 and 213. An enlarged view of the lower left portion of the printhead assembly (marked with a rectangle) is shown in FIG. 7E.

Figure 1E:
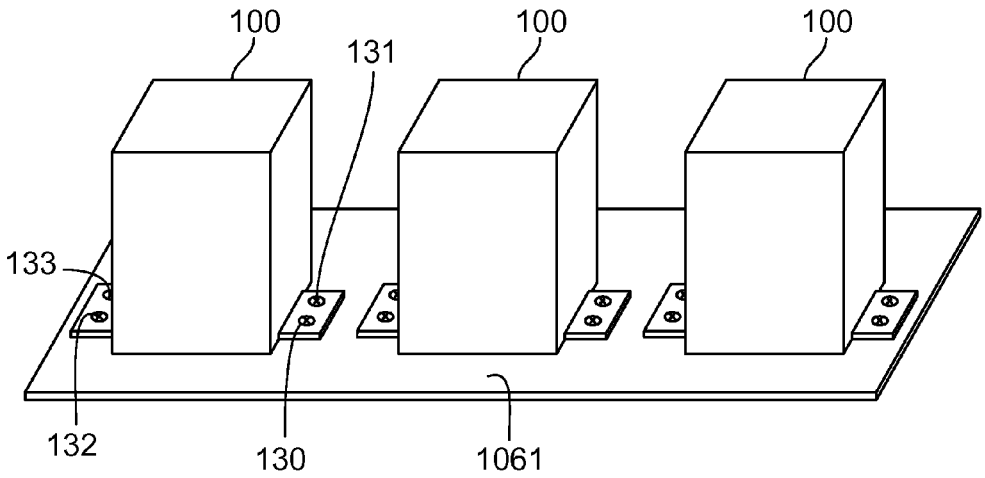
FIG. 1E is a perspective view of printhead assemblies on a print bar.
Figure 1F:
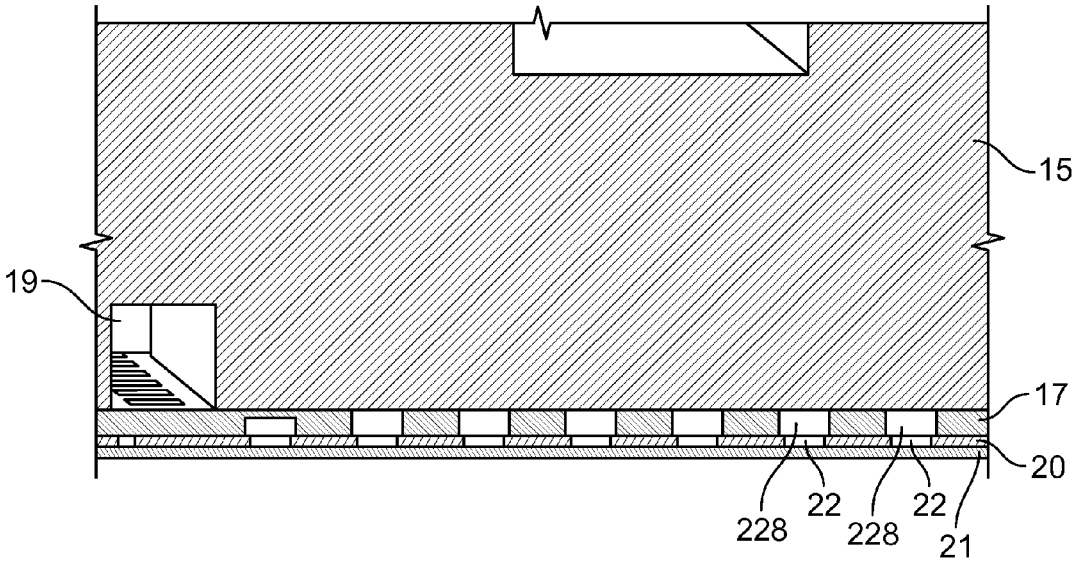
FIG. 1F is a magnified view of a portion of FIG. 1C.
Figure 7E:
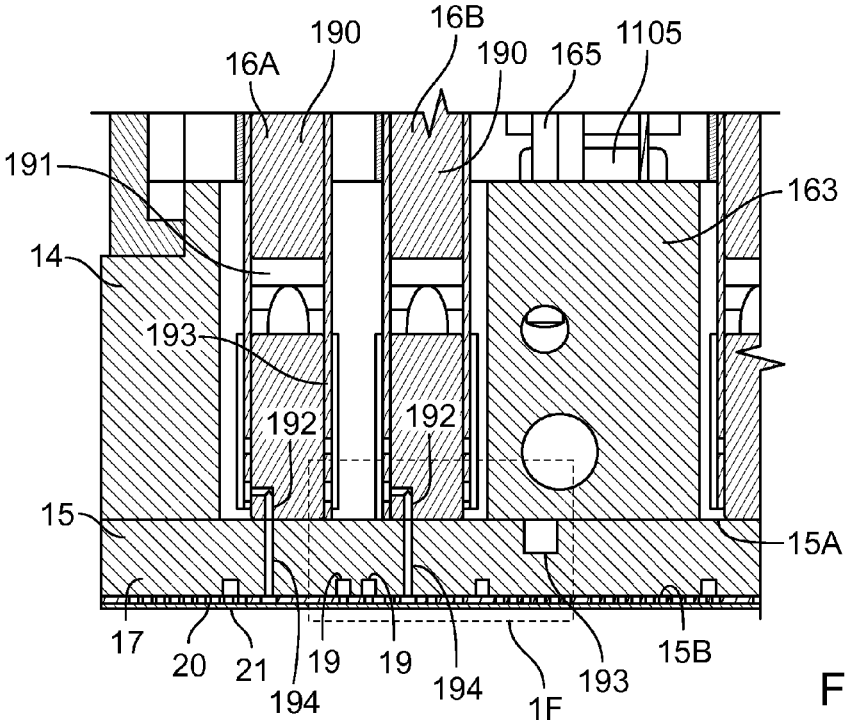
Figure 7F:
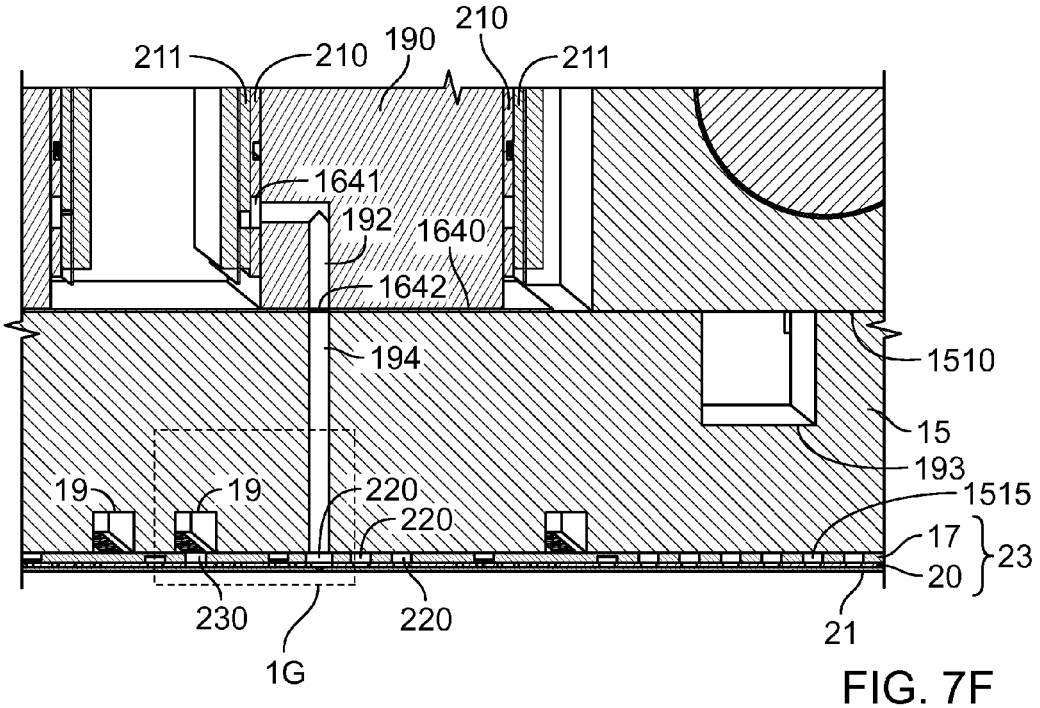

FIG. 7E shows two array modules 16A and 16B. The descender 192 extends through the integrated recirculation manifold 15 as a descender 194. The integrated recirculation manifold has an upper surface 1510 and a lower surface 1515. A total of eight recirculation return manifolds 19 are defined in the lower surface 1515, of which five are shown in FIG. 1E. An enlarged view of the lower middle portion of FIG. 1E is shown in FIG. 1F.

The descender 194 defined in the integrated recirculation manifold 15 connects an end of descender 192 to a descender 220 defined in descender plate 17. An enlarged view of the lower left portion of FIG. 1F is shown in FIG. 1G.

Figure 7G:
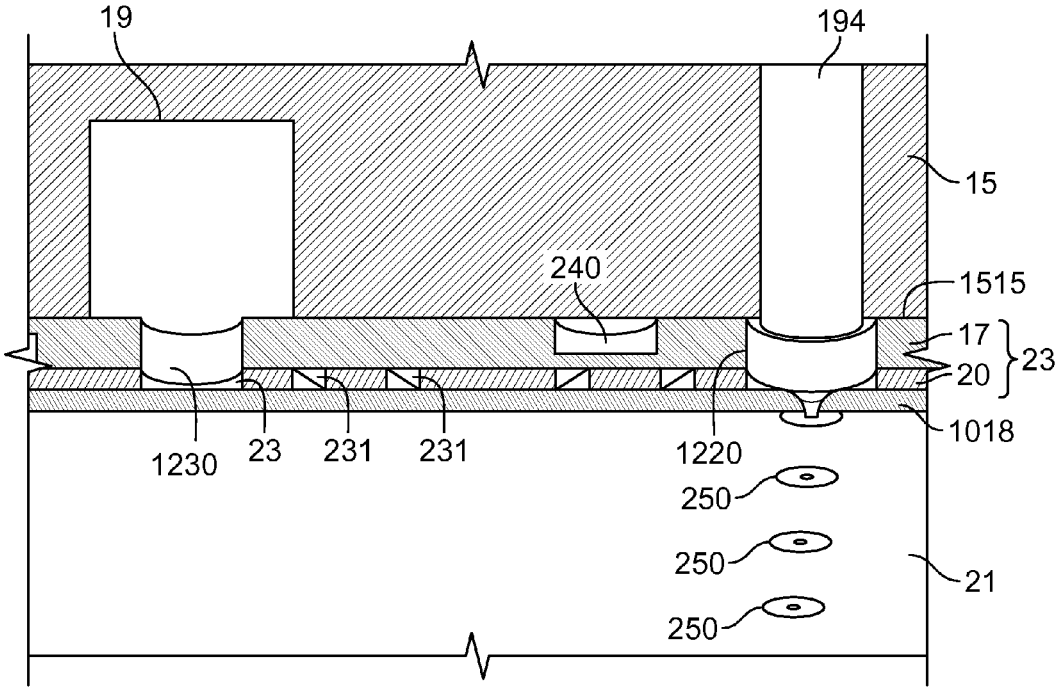

FIG. 7G shows a bottom up view (viewed from the nozzle plate 21) of a portion of the nozzle plate assembly 221. The nozzle plate assembly includes the collar 14, the integrated recirculation manifold 15, the descender plate 17, the nozzle recirculation plate 20 and the nozzle plate 21. The nozzle plate 21 contains a number of nozzle openings 250. The top portions of the figure shows the recirculation return manifold 19 defined in the lower surface 1515 of the integrated recirculation manifold 15. Below the manifold 15 is the descender plate 17 in which a number of descenders 1220 and ascenders 1230 are defined. A void 240, also known as a "glue sucker", serves as an adhesive control feature by holding glue squeezed out between the recirculation manifold 15 and the descender plate 17 during assembly. The descenders 1220 are aligned with a port 22 in the nozzle recirculation plate 20. The descender plate 17 is adhesively bonded to the nozzle recirculation plate 20 to form the laminate piece 23. The port 22 in the nozzle recirculation plate 20 is connected via a V-shaped nozzle recirculation resistor or channel 24 to a port 23 which is aligned with the ascender 1230 in the descender plate 17 to the recirculation return manifold 19. There are equal numbers of descenders 1220 and ascenders 1230 and the total number of descenders 1220 matches the total number of nozzle openings 250. In other words, each nozzle opening 250 has its own dedicated nozzle recirculation resistor 24. The nozzle recirculation resistor 24 is, for example, a fluidic channel. Elements 231 are cross sections of other V-shaped nozzle recirculation resistors 24 that belong to other nozzles 250 arranged into and out of the plane of the drawing in FIG. 1G. The ink that is delivered to the recirculation return manifold 19 exits the printhead assembly 10 through the ink outlet 12.

Figure 7H:
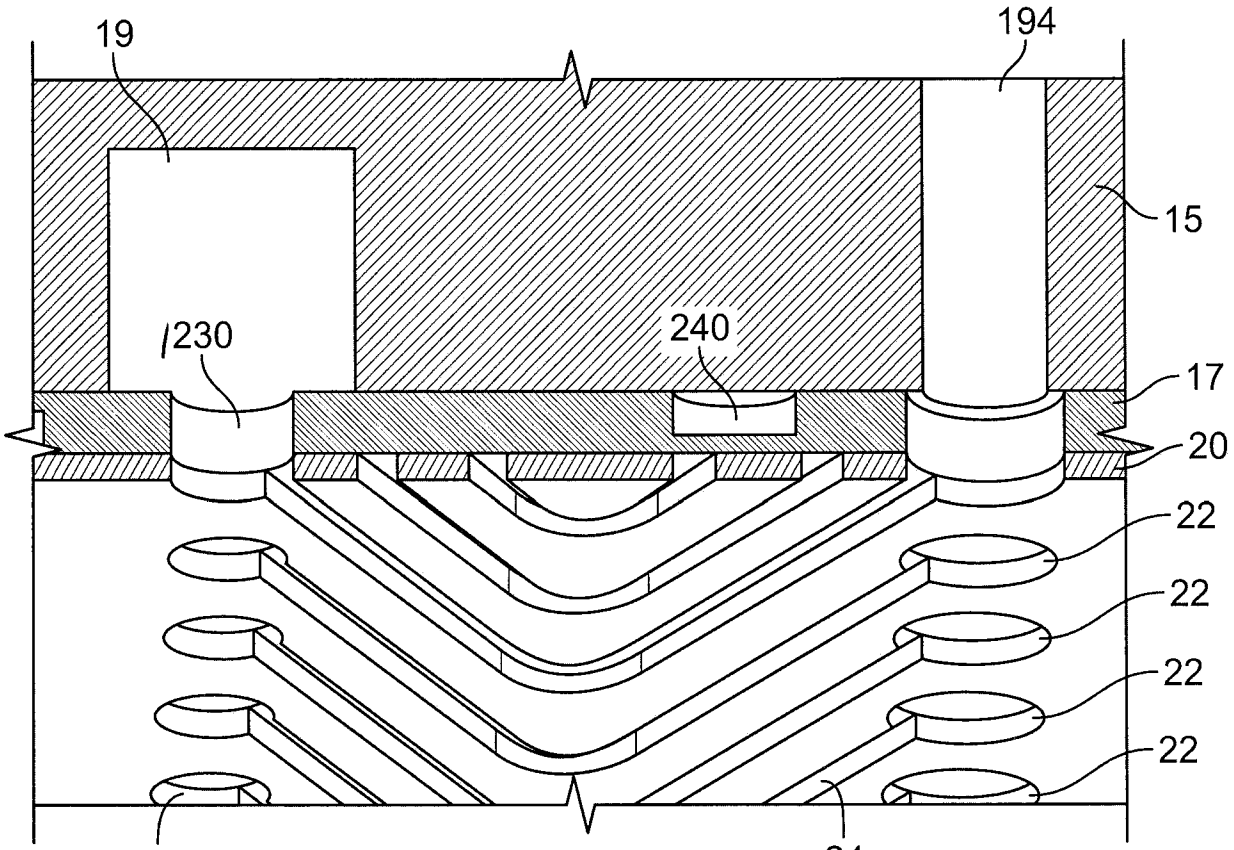

FIG. 7H shows a similar view of the nozzle plate assembly 221, but without the nozzle plate 21. Each V-shaped nozzle recirculation resistor 24 is connected to a respective nozzle opening 250 via the port 22, while the other end of the resistor 24 is connected to the port 23 which directs ink to the recirculation return manifold 19 through the ascender 230 in the descender plate 17.

Figure 8:
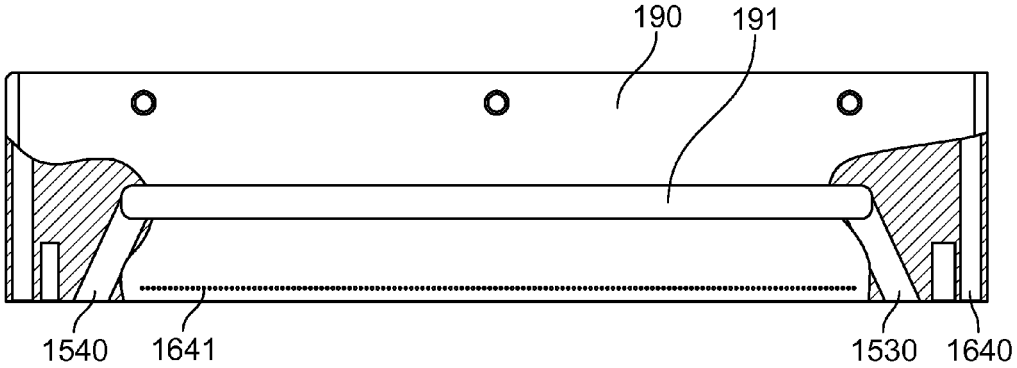
FIG. 8 is a side view of a carbon body.

As shown in FIGS. 1B and 1D, inkjet array modules 16A-D are mounted within slots 161 and 162. Each array module includes a carbon body 190 (shown in FIG. 8) in which a refill chamber 191 is defined. A bottom edge 1640 of the carbon body 190 rests on the integrated recirculation manifold 15 when the array modules 16A-D are assembled in the slots 161 and 162 of the collar 14. The hashed portions of FIG. 8 expose the subsurface features of the carbon body 190. When the carbon body 190 of the inkjet array module is assembled within either slot 161 or 162 in the collar 14, and contacts the top surface 1510 of the integrated recirculation manifold 15, the opening of channel 1530 on the edge 1640 of the carbon body 190 lines up with the throughhole 44 of the integrated recirculation manifold 15. In this way, the ink that leaves the top surface 1510 of the recirculation manifold 15 enters the channel 1530 in the carbon body 190 and is directed upwards into the ink refill chamber 191.

Other implementations are also within the following claims.

What is claimed is:

1. An apparatus comprising:

a body comprising a hollow ink refill chamber;

a structure on a side of the body, the structure comprising a series of posts separating a series of hollow channels adjacent to the hollow ink refill chamber in the body, and a cavity plate on a side of the structure, the cavity plate comprising:

a series of pumping chambers separated by lands, and a rib extending parallel to the hollow ink refill chamber and across the lands.

2. The apparatus of claim 1 in which the structure comprises a plate.

3. The apparatus of claim 2 in which the plate is attached to the body to stiffen the body.

4. The apparatus of claim 3 in which the plate is attached to the body by mechanical bonding.

5. The apparatus of claim 2, further comprising a compliant element on an opposite side of the plate from the body and not in contact with the series of posts.

6. The apparatus of claim 5, wherein the body comprises carbon, the plate comprises stainless steel and the compliant membrane comprises polyimide.

7. The apparatus of claim 2, wherein the plate is adjacent to the body.

8. The apparatus of claim 7, further comprising:

a second plate adjacent to the body, the second plate comprising a second series of posts separating a second series of hollow channels adjacent to the hollow ink refill chamber in the body;

a second compliant element on an opposite side of the second plate from the body and not in contact with the second series of posts; and a second cavity plate comprising a second series of pumping chambers each separated by lands, the second cavity plate being between the second plate and the second compliant element.

9. The apparatus of claim 1, in which the structure is an element separate from the body.

10. The apparatus of claim 2, wherein a width of each post of the series of posts in the plate is within ±10% of a width of a corresponding one of the lands in the cavity plate.

11. The apparatus of claim 10, wherein a thickness of each post of the series of posts corresponds to a thickness of the plate.

12. An apparatus, comprising:

an assembly comprising:

a body comprising a hollow ink refill chamber;

a plate on a side of the body, the plate comprising a series of posts separating a series of hollow channels adjacent to the hollow ink refill chamber in the body;

a compliant element on an opposite side of the plate from the body and not in contact with the series of posts, and a cavity plate between the plate and the compliant element, the cavity plate comprising:

a series of pumping chambers separated by lands, and a rib extending parallel to the hollow ink refill chamber and across the lands.

13. The apparatus of claim 12 in which the plate is attached to the body by mechanical bonding.

14. The apparatus of claim 12, wherein the body comprises carbon, the plate comprises stainless steel and the compliant membrane comprises polyimide.

15. The apparatus of claim 12, wherein the assembly is a jetting assembly, the jetting assembly further comprises piezoelectric elements in contact with the compliant element.

16. The apparatus of claim 15, further comprising:

a collar;

a descender plate; and a nozzle plate; wherein the jetting assembly is held within the collar and is fluidically connected to the descender plate and the nozzle plate.

17. The apparatus of claim 16, further comprising:

a housing; and flexible circuits connecting the jetting assembly to an exterior of the housing;

wherein the jetting assembly is enclosed by the housing.

18. A method, comprising:

providing mechanical support to a body having a hollow ink refill chamber in a direction orthogonal to a length of the hollow ink refill chamber;

providing mechanical support to a cavity plate having a series of pumping chambers separated by lands using a rib that extends parallel to the hollow ink refill chamber and across the lands; and applying a force in the direction to secure the body to an assembly positioned along the direction and under the body.

19. The method of claim 18, further comprising:

detaching the assembly positioned along the direction and under the body from the body and thereafter attaching an assembly under the body.

20. The method of claim 18, the mechanical support is provided through a series of posts separating a series of hollow channels adjacent to the hollow ink refill chamber in the body.

21. The method of claim 20, wherein the body comprises carbon and the series of posts comprises stainless steel.

22. The method of claim 18, wherein the body and the assembly are held together under pressure.

23. The method of claim 22, wherein the body and the assembly are not glued together.

24. The method of claim 18, further comprising:

forming aligned ink flow paths between orifices in the body and descender tubes in the assembly when the force is applied in the direction to secure the body to the assembly.

25. A method comprising:

providing a body comprising a hollow ink refill chamber; and contacting the body with a plate on a side of the body, the plate comprising a series of posts separating a series of hollow channels adjacent to the hollow ink refill chamber in the body, contacting the plate with a cavity plate having a series of pumping chambers separated by lands and providing mechanical support to the cavity plate using a rib that extends parallel to the hollow ink refill chamber and across the lands.

26. The method comprising claim 25, further comprising providing a compliant element on an opposite side of the plate from the body; and during use of the compliant element, the compliant element does not contact the series of posts.

27. The method of claim 26, further comprising:

contacting the body with a second plate on a second side of the body, the second plate comprising a second series of posts separating a second series of hollow channels adjacent to the hollow ink refill chamber in the body.

28. The method of claim 27, further comprising:

applying a force in a direction along a height of the series of the posts; and attaching the body to an assembly positioned along the direction and under the body.

29. The method of claim 28, further comprising:

detaching the body from the assembly.

30. The method of claim 29, further comprising:

cleaning the assembly, the assembly comprising a nozzle plate.

* * * * *

UNITED STATES PATENT AND TRADEMARK OFFICE

CERTIFICATE OF CORRECTION

PATENT NO. : 9,022,520 B2
APPLICATION NO. : 13/786154
DATED : May 5, 2015
INVENTOR(S) : David A. Brady, Robert L. Wells, Jr. and John Kelly It is certified that error appears in the above-identified patent and that said Letters Patent is hereby corrected as shown below:

In the Claims

Column 14, Line 25, Claim 26 after "comprising", insert -- of --

Column 14, Line 25, Claim 26 replace "further comprising" with -- further comprising: --

Signed and Sealed this
Eighth Day of September, 2015

Michelle K. Lee

Michelle K. Lee
*Director of the United States Patent and Trademark Office*